US005642466A

United States Patent [19]

Narayan

[11] Patent Number: 5,642,466

[45] Date of Patent: Jun. 24, 1997

[54] INTONATION ADJUSTMENT IN TEXT-TO-SPEECH SYSTEMS

[75] Inventor: Shankar Narayan, Palo Alto, Calif.

[73] Assignee: Apple Computer, Inc., Cupertino, Calif.

[21] Appl. No.: 7,188

[22] Filed: Jan. 21, 1993

[51] Int. Cl.[6] ..... G10L 5/02; G10L 9/00

[52] U.S. Cl. ..... 395/2.69; 395/2.09; 395/2.67; 395/2.71

[58] Field of Search ..... 381/36–38, 48–52; 395/2, 2.1, 2.14–2.16, 2.67, 2.71, 2.69, 2.76

[56] References Cited

U.S. PATENT DOCUMENTS

| | | | |
|---|---|---|---|
| 4,384,169 | 5/1983 | Mozer et al. . | |
| 4,577,343 | 3/1986 | Oura | 395/2.67 |
| 4,692,941 | 9/1987 | Jacks et al. . | |
| 4,709,390 | 11/1987 | Atal et al. | 395/2.71 |
| 4,797,930 | 1/1989 | Goudie | 381/52 |
| 4,802,223 | 1/1989 | Lin et al. | 381/36 |
| 4,852,168 | 7/1989 | Sprague . | |
| 5,029,211 | 7/1991 | Ozawa | 395/2.16 |

FOREIGN PATENT DOCUMENTS

| | | | |
|---|---|---|---|
| 0030390A1 | 6/1981 | European Pat. Off. | G10L 1/08 |

OTHER PUBLICATIONS

Levinson et al, "Speech synthesis in telecommunications"; IEEE Communications Magazine, vol. 31 iss. 11 pp. 46–53, Nov. 1993.

Yiourgalis et al, "Text-to-Speech system for Greek"; ICASSP 91, pp. 525–528 vol. 1, 14–17 May 1991.

Lewis, "Speech synthesis in a computer aided learning environment"; UK IT 1990, pp. 294–298, 19–22 Mar. 1990.

*Primary Examiner*—David K. Moore
*Assistant Examiner*—Tariq Rafiq Hafiz
*Attorney, Agent, or Firm*—Fliesler, Dubb, Meyer & Lovejoy

[57] ABSTRACT

A software-only real time text-to-speech system includes intonation control which does not introduce discontinuities into output speech stream. The text-to-speech system includes a module for translating text to a sequence of sound segment codes and intonation control signals. A decoder is coupled to the translator to produce sets of digital frames of speech data, which represent sounds for the respective sound segment codes in the sequence. An intonation control system is responsive to intonation control signals for modifying a block of one or more frames in the sets of frames of speech data to generate a modified block. The modified block substantially preserves the continuity of the beginning and ending segments of the block with adjacent frames in the sequence. Thus, when the modified block is inserted in the sequence, no discontinuities are introduced and smooth intonation control is accomplished. The intonation control system provides for both pitch and duration control.

5 Claims, 17 Drawing Sheets

TEXT - TO - SPEECH CODE

NOTES:

T = Desired duration of a phoneme $f_b$ = Desired Beginning Pitch in Hz $f_e$ = Desired Ending Pitch in Hz P1, P2, ..., P6 are the desired pitch period in No. of Samples corresponding to the frequencies f1,f2,...f6.

Relationship between Pi and fi:

Pi = Fs/fi, where Fs is the Sampling frequency.

INTONATION ADJUSTMENT IN TEXT-TO-SPEECH SYSTEMS

CROSS-REFERENCE TO RELATED APPLICATION

The present application is related to U.S. Patent Application entitled METHOD AND APPARATUS FOR PROSODY OF SYNTHETIC SPEECH, invented by Scott E. Meredith, U.S. Patent Application entitled DIRECT MANIPULATION INTERFACE FOR PROSODY CONTROL OF SPEECH, invented by Scott E. Meredith, and U.S. Patent Application entitled METHOD AND APPARATUS FOR AUTOMATIC ASSIGNMENT OF DURATION VALUES FOR SYNTHETIC SPEECH, invented by Scott E. Meredith, which are being filed on the same day as the present application, and are owned now and were owned at the time of the inventions by the same Assignee. This related application is incorporated by reference as if fully set forth herein.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever.

BACKGROUND OF THE INVENTION

1. Field of the Invention

The present invention relates to translating text in a computer system to synthesized speech; and more particularly to techniques used in such systems for control of intonation in synthesized speech.

2. Description of the Related Art

In text-to-speech systems, stored text in a computer is translated to synthesized speech. As can be appreciated, this kind of system would have wide spread application if it were of reasonable cost. For instance, a text-to-speech system could be used for reviewing electronic mail remotely across a telephone line, by causing the computer storing the electronic mail to synthesize speech representing the electronic mail. Also, such systems could be used for reading to people who are visually impaired. In the word processing context, text-to-speech systems might be used to assist in proofreading a large document.

However in prior art systems which have reasonable cost, the quality of the speech has been relatively poor making it uncomfortable to use or difficult to understand. In order to achieve good quality speech, prior art speech synthesis systems need specialized hardware which is very expensive, and/or a large amount of memory space in the computer system generating the sound.

Prior art systems which have addressed this problem are described in part in U.S. Pat. No. 8,452,168, entitled COMPRESSION OF STORED WAVE FORMS FOR ARTIFICIAL SPEECH, invented by Sprague; and U.S. Pat. No. 4,692,941, entitled REAL-TIME TEXT-TO-SPEECH CONVERSION SYSTEM, invented by Jacks, et al. Further background concerning speech synthesis may be found in U.S. Pat. No. 4,384,169, entitled METHOD AND APPARATUS FOR SPEECH SYNTHESIZING, invented by Mozer, et al.

In text-to-speech systems, an algorithm reviews an input text string, and translates the words in the text string into a sequence of diphones which must be translated into synthesized speech. Also, text-to-speech systems analyze the text based on word type and context to generate intonation control used for adjusting the duration of the sounds and the pitch of the sounds involved in the speech.

Diphones consist of a unit of speech composed of the transition between one sound, or phoneme, and an adjacent sound, or phoneme. Diphones typically are encoded as a sequence of frames of sound data starting at the center of one phoneme and ending at the center of a neighboring phoneme. This preserves the transition between the sounds relatively well. The encoded diphones have a nominal pitch determined by the length of a pitch period in the encoded speech and a nominal duration determined by the number of pitch periods corresponding to a particular encoded sound. These nominal values must be adjusted to synthesize natural sounding speech.

Intonation control in such systems involves lengthening or shortening particular frames, or pitch periods, of speech data for pitch control, and inserting or deleting frames associated with particular sounds for duration control. Prior art systems have accomplished these modifications by relatively crude clipping and extrapolation on pitch period boundaries that introduce discontinuities in output speech data sequences. In some cases, these discontinuities may introduce audible clicks or other noise.

Notwithstanding the prior work in this area, the use of text-to-speech systems has not gained widespread acceptance. It is desireable therefore to provide a software only text-to-speech system which is portable to a wide variety of microcomputer platforms, and conserves memory space in such platforms for other uses, and performs intonation control with high quality.

SUMMARY OF THE INVENTION

The present invention provides a software-only real time text-to-speech system including intonation control which does not introduce discontinuities into output speech stream. The intonation control system adjusts the intonation of sounds represented by a sequence of frames having respective lengths of digital samples. It includes a means that receives intonation control signals and a buffer for storing frames in the sequence of sound data. The intonation control system is responsive to the intonation control signals for modifying a block of one or more frames in the sequence to generate a modified block. The modified block substantially preserves the continuity of the beginning and ending segments of the block with adjacent frames in the sequence. Thus, when the modified block is inserted in the sequence, no discontinuities are introduced and smooth intonation control is accomplished.

According to one aspect of the invention, the intonation control signals include pitch control signals which indicate an amount of adjustment of the nominal lengths of particular frames in the sequence. Also, the intonation control signal may include duration control signals which indicate an amount to reduce or increase the number of frames in the sequence corresponding to particular sounds.

The pitch adjustment means includes a pitch lowering module which increases the length N of a particular frame by amount of $\Delta$ samples. In this case, the block which is modified consists of the particular frame. A first weighting function is applied to the block in the buffer emphasizing the beginning segment to generate a first vector, and a second weighting function is applied to the block emphasizing the ending segment to generate a second vector. The first vector is combined with the second vector shifted by Δ samples to generate a modified block of length N+Δ.

A pitch raising module is included for decreasing the length N of a particular frame by amount Δ. In this case, the block stored in the buffer consists of the particular frame subject of pitch adjustment and the next frame in the sequence of length NR. A first weighting function is applied to the block emphasizing the beginning segment to generate a first vector, and a second weighting function is applied to the block emphasizing the ending segment to generate a second vector. The first vector is combined with the second vector shifted by Δ samples to generate a shortened frame, and the shortened frame is concatenated with the next frame to produce a modified block of length N−Δ+NR.

Duration control includes duration shortening modules and duration lengthening modules. In the duration shortening module, the duration control signals indicate an amount to reduce the number of frames in a sequence that correspond to a particular sound. In this case, the block stored in the buffer consists of two sequential frames of respective lengths NL and NR which correspond to a particular sound. A first weighting function is applied to the block emphasizing the beginning segment to generate a first vector, and a second weighting function is applied to the block emphasizing the ending segment to generate a second vector. The first and second vectors are combined to generate a modified block having the length either NL or the length NR.

The duration lengthening module is responsive to duration control signals which indicate an amount to increase the number of frames in the sequence which correspond to a particular sound. In this case, the block to be modified consists of left and right sequential frames of respective lengths NL and NR which correspond to the particular sound. A first weighting function is applied to the block emphasizing the beginning segment to generate a first vector. A second weighting function is applied to the block emphasizing the ending segment to generate a second vector. The first and second vectors are combined to generate a new frame for insertion in the sequence. The left frame, the new frame, and the right frame are concatenated to produce the modified block.

According to another aspect of the invention, the intonation control is explicitly applied to speech data, in a text-to-speech system. The text-to-speech system includes a module for translating text to a sequence of sound segment codes and intonation control signals. A decoder is coupled to the translator to produce sets of digital frames which represent sounds for the respective sound segment codes in the sequence. An intonation adjustment module as described above is included which is responsive to the translator, and to modify the outputs of the decoder to produce an intonation adjusted sequence of data. An audio transducer receives the intonation adjusted sequence to produce synthesized speech.

By modifying speech data to adjust the intonation without introducing discontinuities between frames of speech data, a much improved text-to-speech system is achieved. Furthermore, the present invention is well suited to real time application in a wide variety of standard microcomputer platforms, such as the Apple Macintosh class computers, DOS based computers, UNIX based computers, and the like. The system occupies a relatively small amount of system memory, and utilizes the relatively small amount of processor resources to achieve very high quality synthesized speech.

Other aspects and advantages of the present invention can be seen upon review of the figures, the detailed description, and the claims which follow.

DETAILED DESCRIPTION OF PREFERRED EMBODIMENTS

Figure 1:
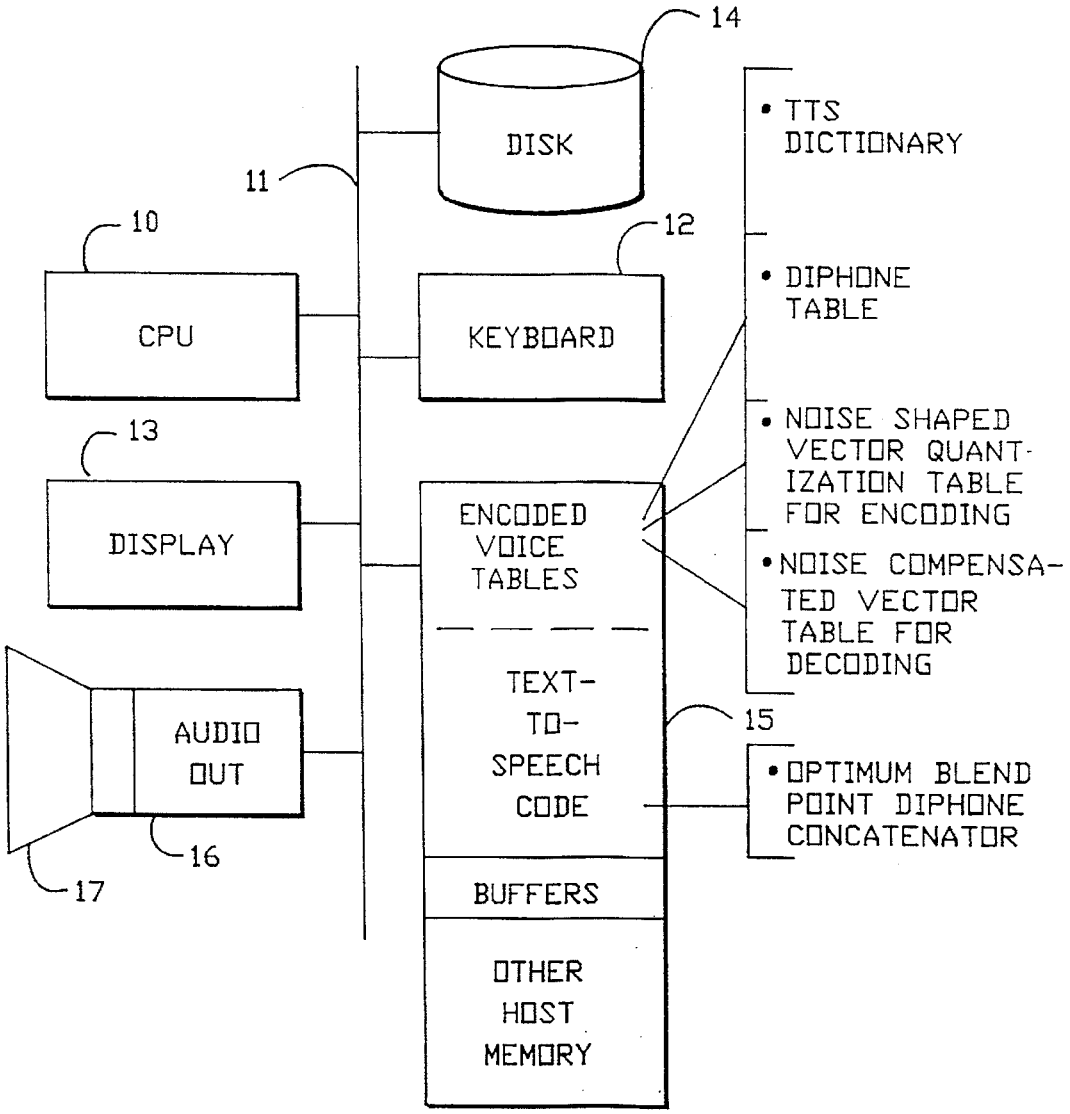
FIG. 1 is a block diagram of a generic hardware platform incorporating the text-to-speech system of the present invention.
Figure 2:
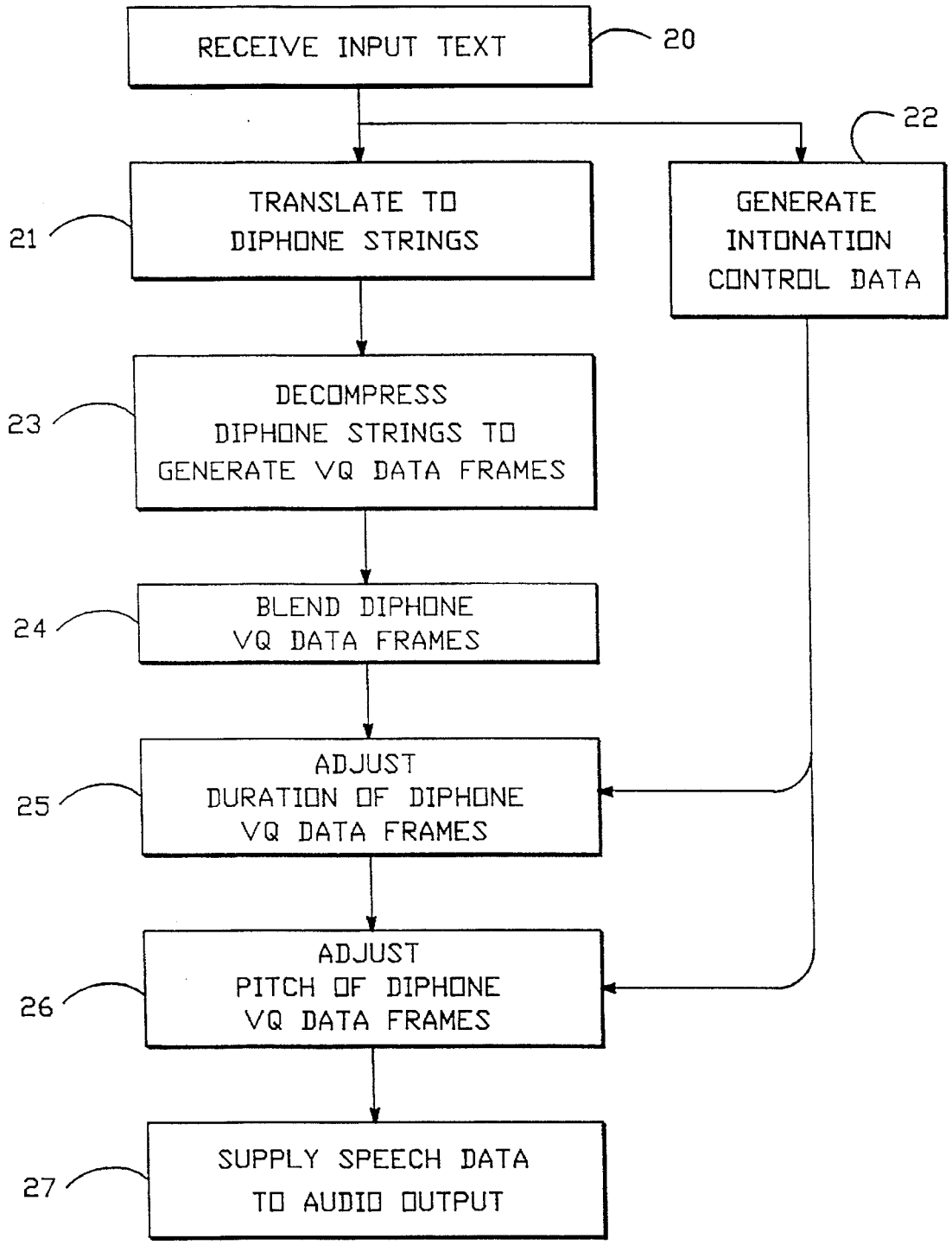
FIG. 2 is a flow chart illustrating the basic text-to-speech routine according to the present invention.
Figure 3:
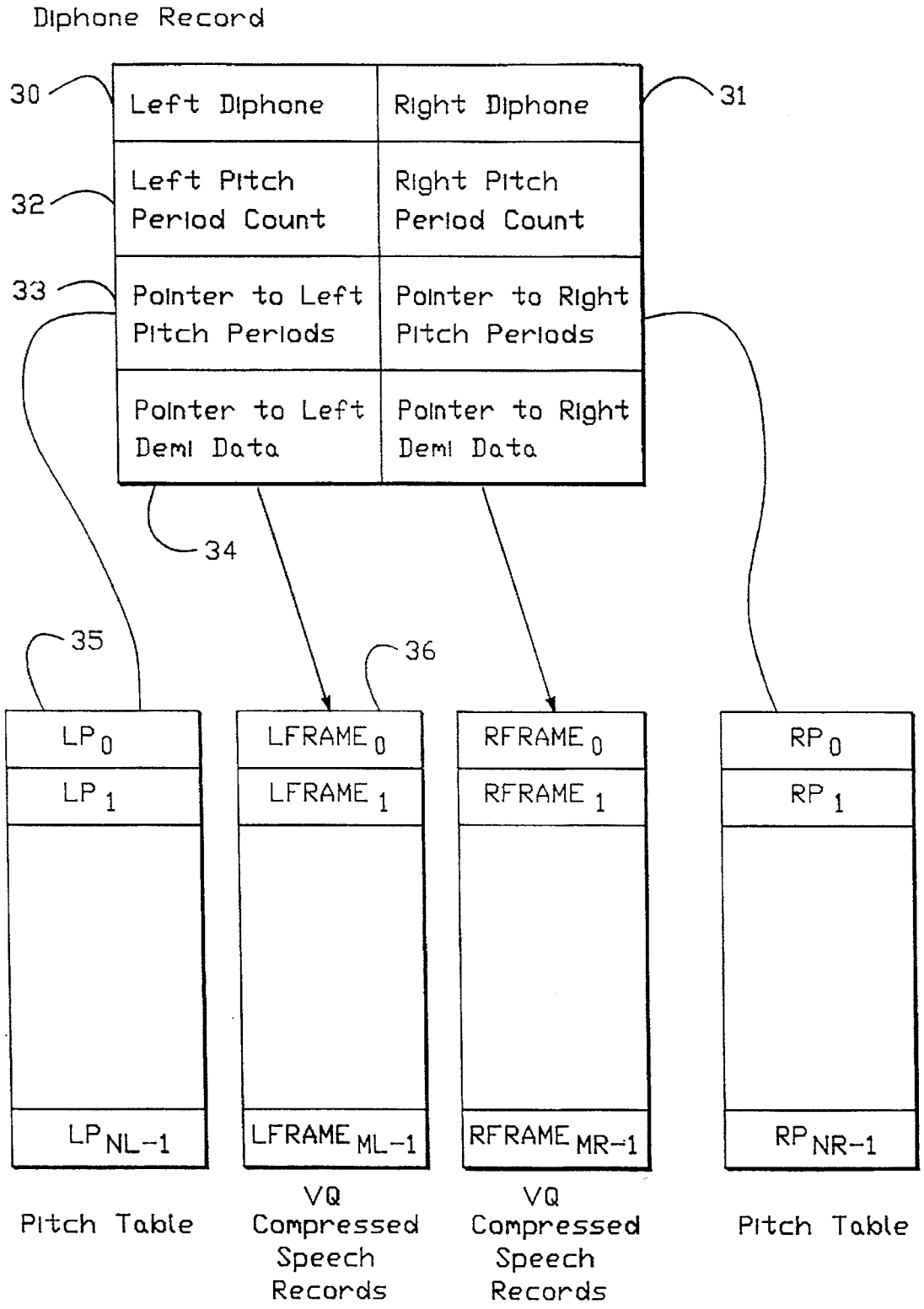
FIG. 3 illustrates the format of diphone records according to one embodiment of the present invention.
Figure 4:
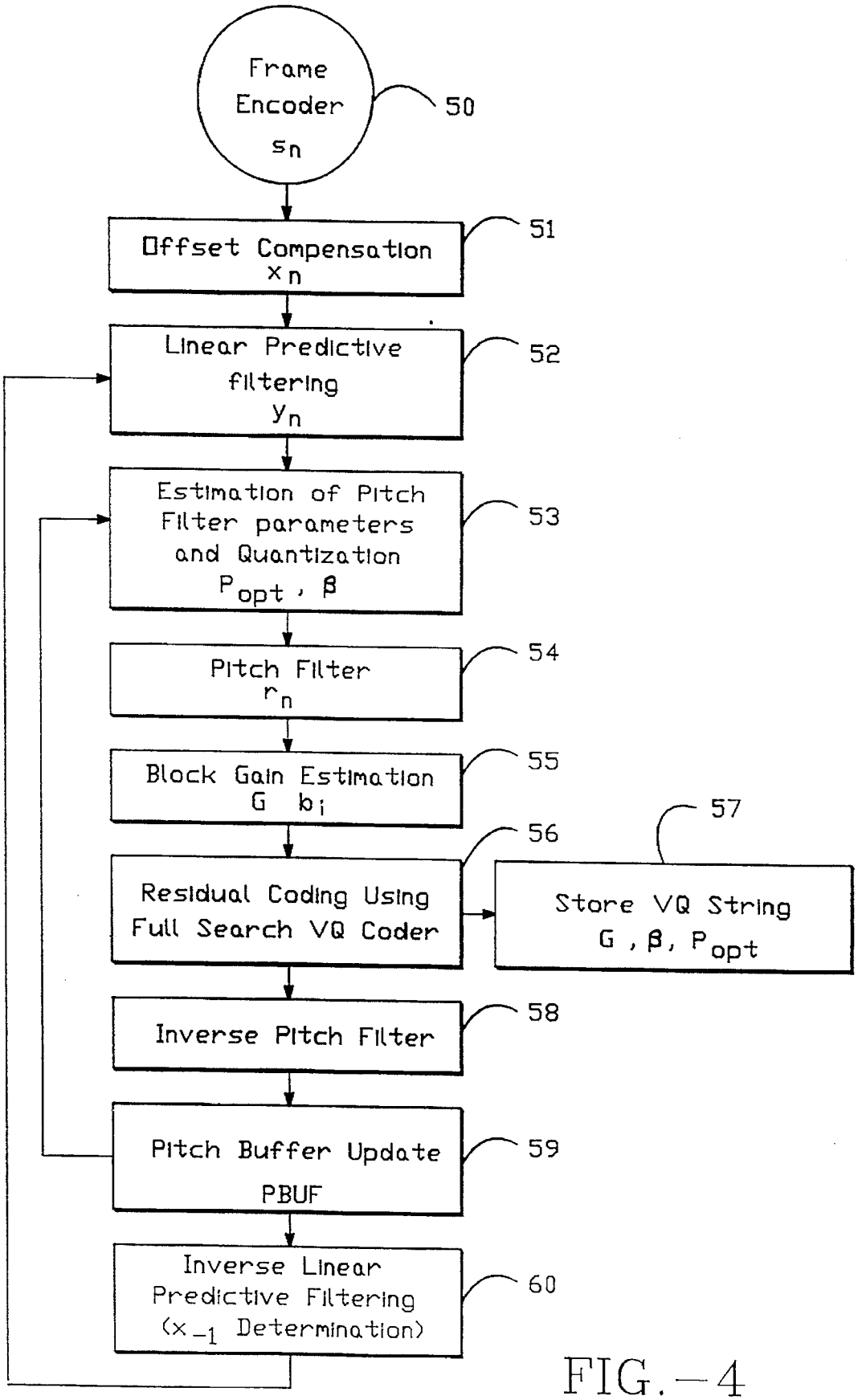
FIG. 4 is a flow chart illustrating the encoder for speech data according to the present invention.
Figure 5:
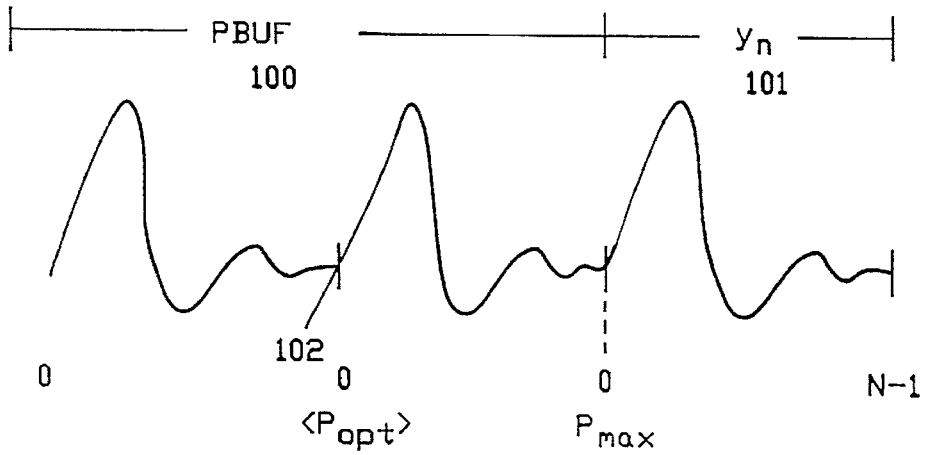
FIG. 5 is a graph discussed in reference to the estimation of pitch filter parameters in the encoder of FIG. 4.
Figure 6:
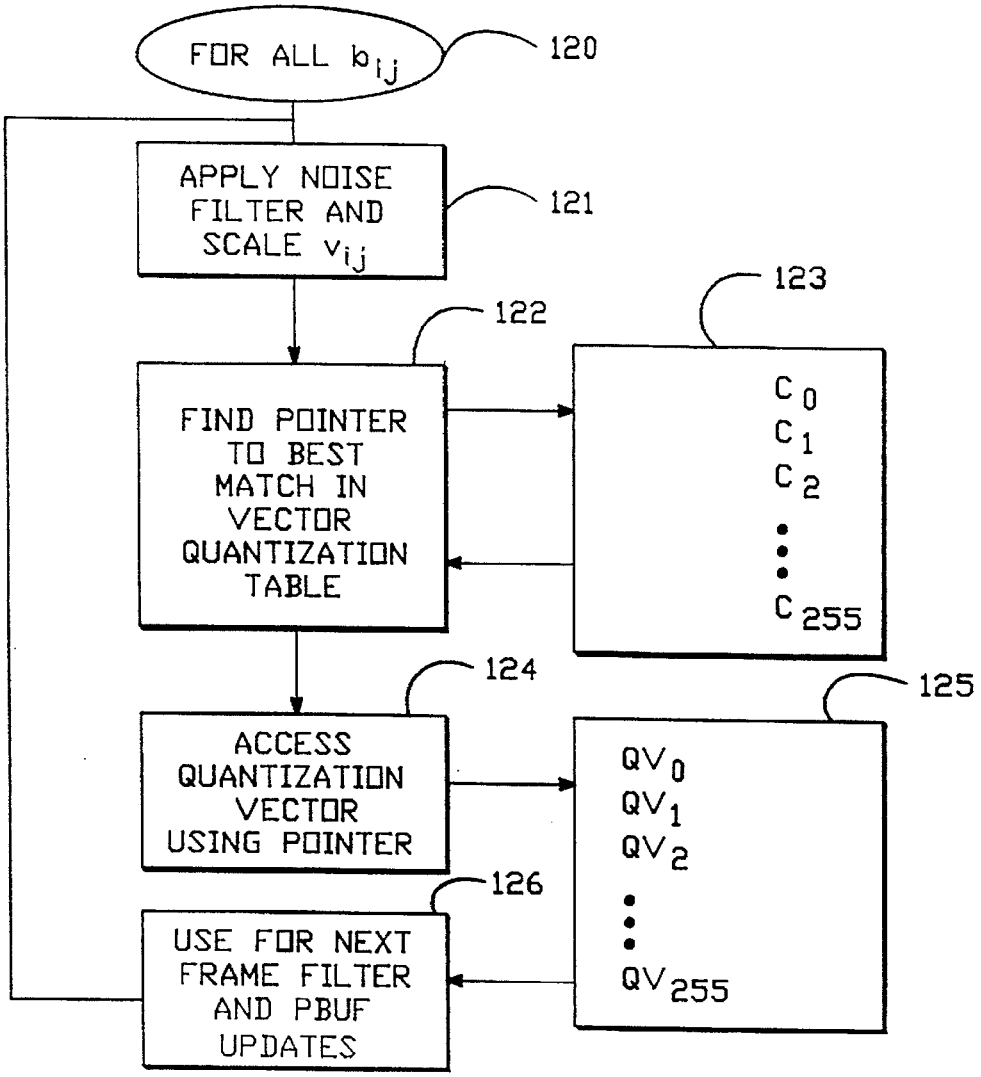
FIG. 6 is a flow chart illustrating the full search used in the encoder of FIG. 4.
Figure 7:
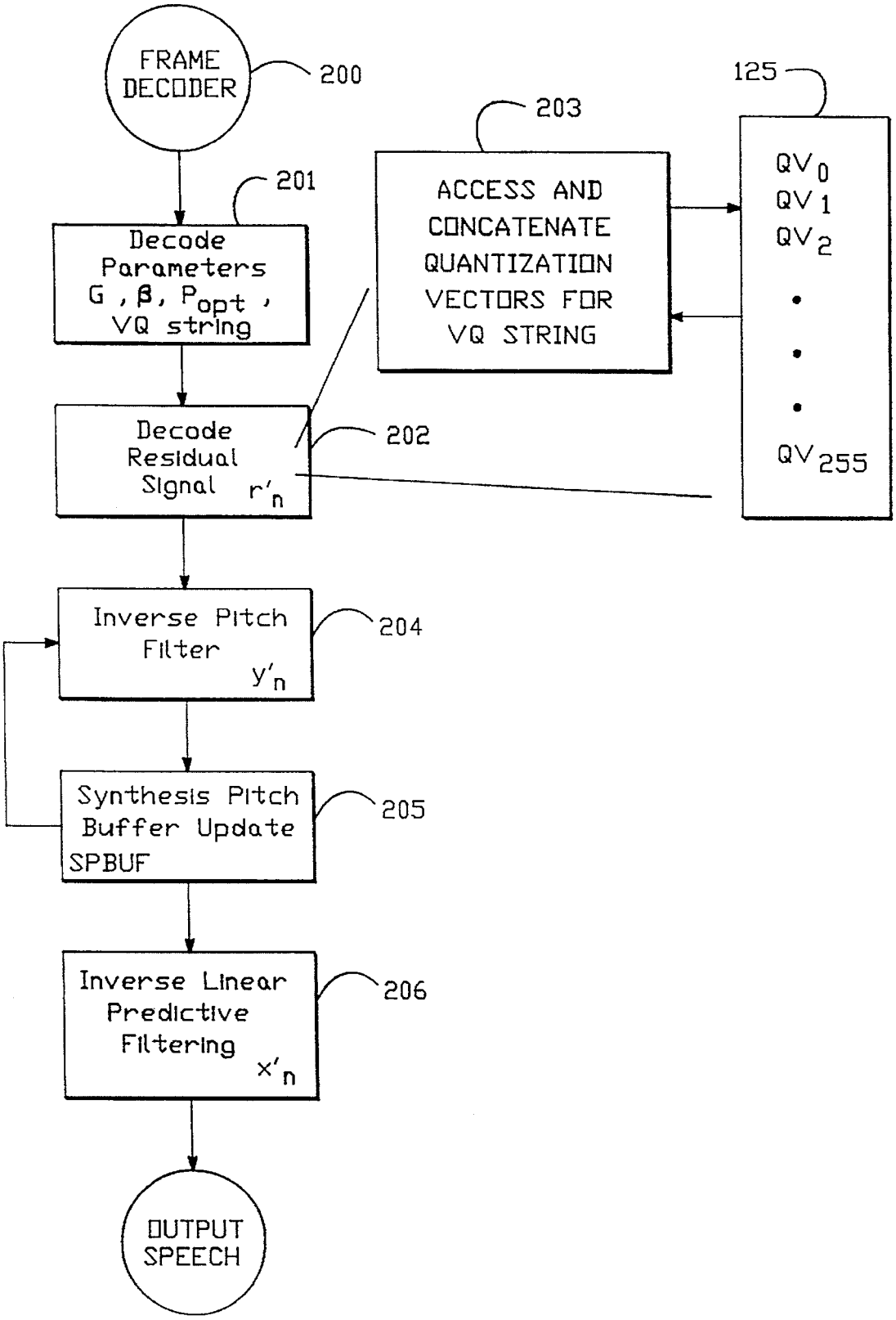
FIG. 7 is a flow chart illustrating a decoder for speech data according to the present invention.

A detailed description of preferred embodiments of the present invention is provided with reference to the figures. FIGS. 1 and 2 provide a overview of a system incorporating the present invention. FIG. 3 illustrates the basic manner in which diphone records are stored according to the present invention. FIGS. 4–6 illustrate the encoding methods based on vector quantization of the present invention. FIG. 7 illustrates the decoding algorithm according to the present invention.

FIGS. 8 and 9*a–c* illustrate a preferred technique for blending the beginning and ending of adjacent diphone records. FIGS. 10, 11, 12*a–e*, 13, 14*a–c*, 15, 16*a–c*, 17, and 18*a–c* illustrate the techniques for controlling the pitch and duration of sounds in the text-to-speech system.

I. System Overview (FIGS. 1–3)

FIG. 1 illustrates a basic microcomputer platform incorporating a text-to-speech system based on vector quantization according to the present invention. The platform includes a central processing unit 10 coupled to a host system bus 11. A keyboard 12 or other text input device is provided in the system. Also, a display system 13 is coupled to the host system bus. The host system also includes a non-volatile storage system such as a disk drive 14. Further, the system includes host memory 15. The host memory includes text-to-speech (TTS) code, including encoded voice tables, buffers, and other host memory. The text-to-speech code is used to generate speech data for supply to an audio output module 16 which includes a speaker 17.

According to the present invention, the encoded voice tables include a TTS dictionary which is used to translate text to a string of diphones. Also included is a diphone table which translates the diphones to identified strings of quantization vectors. A quantization vector table is used for decoding the sound segment codes of the diphone table into the speech data for audio output. Also, the system may include a vector quantization table for encoding which is loaded into the host memory 15 when necessary. Also, the text-to-speech code in the instruction memory includes an intonation control module which preserves the continuity of encoded speech, while providing sophisticated pitch and duration control.

The platform illustrated in FIG. 1 represents any generic microcomputer system, including a Macintosh based system, an DOS based system, a UNIX based system or other types of microcomputers. The text-to-speech code and encoded voice tables according to the present invention for decoding occupy a relatively small amount of host memory 15. For instance, a text-to-speech decoding system according to the present invention may be implemented which occupies less than 640 kilobytes of main memory, and yet produces high quality, natural sounding synthesized speech.

The basic algorithm executed by the text-to-speech code is illustrated in FIG. 2. The system first receives the input text (block 20). The input text is translated to diphone strings using the TTS dictionary (block 21). At the same time, the input text is analyzed to generate intonation control data, to control the pitch and duration of the diphones making up the speech (block 22). The intonation control signals in the preferred system may be produced for instance as described in the related applications, incorporated by reference above.

After the text has been translated to diphone strings, the diphone strings are decompressed to generate vector quantized data frames (block 23). After the vector quantized (VQ) data frames are produced, the beginnings and endings of adjacent diphones are blended to smooth any discontinuities (block 24). Next, the duration and pitch of the diphone VQ data frames are adjusted in response to the intonation control data (block 25 and 26). Finally, the speech data is supplied to the audio output system for real time speech production (block 27). For systems having sufficient processing power, an adaptive post filter may be applied to further improve the speech quality.

The TTS dictionary can be implemented using any one of a variety of techniques known in the art. According to the present invention, diphone records are implemented as shown in FIG. 3 in a highly compressed format.

As shown in FIG. 3, records for a left diphone 30 and a record for a right diphone 31 are shown. The record for the left diphone 30 includes a count 32 of the number NL of pitch periods in the diphone. Next, a pointer 33 is included which points to a table of length NL storing the number $LP_i$ for each pitch period, i goes from 0 to NL−1 of pitch values for corresponding compressed frame records. Finally, pointer 34 is included to a table 36 of ML vector quantized compressed speech records, each having a fixed set length of encoded frame size related to nominal pitch of the encoded speech for the left diphone. The nominal pitch is based upon the average number of samples for a given pitch period for the speech data base.

A similar structure can be seen for the right diphone 31. Using vector quantization, a length of the compressed speech records is very short relative to the quality of the speech generated.

The format of the vector quantized speech records can be understood further with reference to the frame encoder routine and the frame decoder routine described below with reference to FIGS. 4–7.

II. The Encoder/Decoder Routines (FIGS. 4–7)

The encoder routine is illustrated in FIG. 4. The encoder accepts as input a frame $s_n$ of speech data. In the preferred system, the speech samples are represented as 12 or 16 bit two's complement numbers, sampled at 22,252 Hz. This data is divided into non-overlapping frames $s_n$ having a length of N, where N is referred to as the frame size. The value of N depends on the nominal pitch of the speech data. If the nominal pitch of the recorded speech is less than 165 samples (or 135 Hz), the value of N is chosen to be 96. Otherwise a frame size of 160 is used. The encoder transforms the N-point data sequence $s_n$ into a byte stream of shorter length, which depends on the desired compression rate. For example, if N=160 and very high data compression is desired, the output byte stream can be as short as 12 eight bit bytes. A block diagram of the encoder is shown in FIG. 4.

Thus, the routine begins by accepting a frame $s_n$ (block 50). To remove low frequency noise, such as DC or 60 Hz power line noise, and produce offset free speech data, signal $s_n$ is passed through a high pass filter. A difference equation used in a preferred system to accomplish this is set out in Equation 1 for $0 \leqq n < N$.

$$x_n = s_n - s_{n-1} + 0.999 * x_{n-1} \qquad \text{Equation 1}$$

The value $x_n$ is the "offset free" signal. The variables $s_{-1}$ and $x_{-1}$ are initialized to zero for each diphone and are subsequently updated using the relation of Equation 2.

$$x_{-1} = x_N \text{ and } s_{-1} = s_N \qquad \text{Equation 2}$$

This step can be referred to as offset compensation or DC removal (block 51).

In order to partially decorrelate the speech samples and the quantization noise, the sequence $x_n$ is passed through a fixed first order linear prediction filter. The difference equation to accomplish this is set forth in Equation 3.

$$y_n = x_n - 0.875 * x_{n-1} \qquad \text{Equation 3}$$

The linear prediction filtering of Equation 3 produces a frame $y_n$ (block 52). The filter parameter, which is equal to 0.875 in Equation 3, will have to be modified if a different speech sampling rate is used. The value of $x_{-1}$ is initialized to zero for each diphone, but will be updated in the step of inverse linear prediction filtering (block 60) as described below.

It is possible to use a variety of filter types, including, for instance, an adaptive filter in which the filter parameters are dependent on the diphones to be encoded, or higher order filters.

The sequence $y_n$ produced by Equation 3 is then utilized to determine an optimum pitch value, $P_{opt}$, and an associated gain factor, β. $P_{opt}$ is computed using the functions $s_{xy}(P)$, $s_{xx}(P)$, $s_{yy}(P)$, and the coherence function Coh(P) defined by Equations 4, 5, 6 and 7 as set out below.

$$s_{xy}(P) = \sum_{n=0}^{N-1} y_n * PBUF_{P_{max}-P+n} \quad \text{Equation 4}$$

$$s_{xx}(P) = \sum_{n=0}^{N-1} y_n * y_n \quad \text{Equation 5}$$

$$s_{yy}(P) = \sum_{N=0}^{N-1} PBUF_{P_{max}-P+n} * PBUF_{P_{max}-P+n} \quad \text{Equation 6}$$

and $$Coh(P) = s_{xy}(P) * s_{xy}(P)/(s_{xx}(P) * s_{yy}(P)) \quad \text{Equation 7}$$

PBUF is a pitch buffer of size $P_{max}$, which is initialized to zero, and updated in the pitch buffer update block 59 as described below. $P_{opt}$ is the value of P for which Coh(P) is maximum and $s_{xy}(P)$ is positive. The range of P considered depends on the nominal pitch of the speech being coded. The range is (96 to 350) if the frame size is equal to 96 and is (160 to 414) if the frame size is equal to 160. $P_{max}$ is 350 if nominal pitch is less than 160 and is equal to 414 otherwise. The parameter $P_{opt}$ can be represented using 8 bits.

The computation of $P_{opt}$ can be understood with reference to FIG. 5. In FIG. 5, the buffer PBUF is represented by the sequence 100 and the frame $y_n$ is represented by the sequence 101. In a segment of speech data in which the preceding frames are substantially equal to the frame $y_n$, PBUF and $y_n$ will look as shown in FIG. 5. $P_{opt}$ will have the value at point 102, where the vector $y_n$ 101 matches as closely as possible a corresponding segment of similar length in PBUF 100.

The pitch filter gain parameter β is determined using the expression of Equation 8.

$$\beta = s_{xy}(P_{opt})/s_{yy}(P_{opt}). \quad \text{Equation 8}$$

β is quantized to four bits, so that the quantized value of β can range from 1/16 to 1, in steps of 1/16.

Next, a pitch filter is applied (block 54). The long term correlations in the pre-emphasized speech data $y_n$ are removed using the relation of Equation 9.

$$r_n = y_n - \beta * PBUF_{P_{max}-P_{opt}+n}, \quad 0 \leqq n < N. \quad \text{Equation 9}$$

This results in computation of a residual signal $r_n$.

Next, a scaling parameter G is generated using a block gain estimation routine (block 55). In order to increase the computational accuracy of the following stages of processing, the residual signal $r_n$ is rescaled. The scaling parameter, G, is obtained by first determining the largest magnitude of the signal $r_n$ and quantizing it using a 7-level quantizer. The parameter G can take one of the following 7 values: 256, 512, 1024, 2048, 4096, 8192, and 16384. The consequence of choosing these quantization levels is that the rescaling operation can be implemented using only shift operations.

Next the routine proceeds to residual coding using a full search vector quantization code (block 56). In order to code the residual signal $r_n$, the n point sequence $r_n$ is divided into non-overlapping blocks of length M, where M is referred to as the "vector size". Thus, M sample blocks $b_{ij}$ are created, where i is an index from zero to M−1 on the block number, and j is an index from zero to N/M−1 on the sample within the block. Each block may be defined as set out in Equation 10.

$$b_{ij} = r_{Mi+j}, \ (0 \leqq i < N/M \text{ and } j \leqq 0 < M) \quad \text{Equation 10}$$

Each of these M sample blocks $b_{ij}$ will be coded into an 8 bit number using vector quantization. The value of M depends on the desired compression ratio. For example, with M equal to 16, very high compression is achieved (i.e., 16 residual samples are coded using only 8 bits). However, the decoded speech quality can be perceived to be somewhat noisy with M=16. On the other hand, with M=2, the decompressed speech quality will be very close to that of uncompressed speech. However the length of the compressed speech records will be longer. The preferred implementation, the value M can take values 2, 4, 8, and 16.

The vector quantization is performed as shown in FIG. 6. Thus, for all blocks $b_{ij}$ a sequence of quantization vectors is identified (block 120). First, the components of block $b_{ij}$ are passed through a noise shaping filter and scaled as set out in Equation 11 (block 121).

$$w_j = 0.875 * w_{j-1} - 0.5 * w_{j-2} + 0.4375 * w_{j-3} + b_{ij}, \quad 0 \leqq j < M \quad \text{Equation 11}$$

$$v_{ij} = G * w_j \quad 0 \leqq j < M$$

Thus, $v_{ij}$ is the jth component of the vector $v_i$, and the values $w_{-1}$, $w_{-2}$ and $w_{-3}$ are the states of the noise shaping filter and are initialized to zero for each diphone. The filter coefficients are chosen to shape the quantization noise spectra in order to improve the subjective quality of the decompressed speech. After each vector is coded and decoded, these states are updated as described below with reference to blocks 124–126.

Next, the routine finds a pointer to the best match in a vector quantization table (block 122). The vector quantization table 123 consists of a sequence of vectors $C_0$ through $C_{255}$ (block 123).

Thus, the vector $v_i$ is compared against 256 M-point vectors, which are precomputed and stored in the code table 123. The vector $C_{qi}$ which is closest to $v_i$ is determined according to Equation 12. The value $C_p$ for p=0 through 255 represents the $p^{th}$ encoding vector from the vector quantization code table 123.

$$\min_p \sum_{j=0}^{M-1} (v_{ij} - C_{pj})^2 \quad \text{Equation 12}$$

The closest vector $C_{qi}$ can also be determined efficiently using the technique of Equation 13.

$$v_i^T \cdot C_{qi} \leqq v_i^T \cdot C_p \text{ for all } p(0 \leqq p \leqq 255) \quad \text{Equation 13}$$

In Equation 13, the value $v^T$ represents the transpose of the vector v, and "·" represents the inner product operation in the inequality.

The encoding vectors $C_p$ in table 123 are utilized to match on the noise filtered value $v_{ij}$. However in decoding, a decoding vector table 125 is used which consists of a sequence of vectors $QV_p$. The values $QV_p$ are selected for the purpose of achieving quality sound data using the vector quantization technique. Thus, after finding the vector $C_{qi}$, the pointer q is utilized to access the vector $QV_{qi}$. The decoded samples corresponding to the vector $b_i$ which is produced at step 55 of FIG. 4, is the M-point vector (1/G)*$QV_{qi}$. The vector $C_p$ is related to the vector $QV_p$ by the noise shaping filter operation of Equation 11. Thus, when the decoding vector $QV_p$ is accessed, no inverse noise shaping filter needs to be computed in the decode operation. The table 125 of FIG. 6 thus includes noise compensated quantization vectors.

In continuing to compute the encoding vectors for the vectors $b_{ij}$ which make up the residual signal $r_n$, the decoding vector of the pointer to the vector $b_i$ is accessed (block 124). That decoding vector is used for filter and PBUF updates (block 126).

For the noise shaping filter, after the decoded samples are computed for each sub-block $b_i$, the error vector $(b_i - QV_{qi})$ is passed through the noise shaping filter as shown in Equation 14.

$$W_j = 0.875 * W_{j-1} - 0.5 * W_{j-2} + 0.4375 * W_{j-3} + [b_{ij} - QV_{qi}(j)] \quad 0 \leqq j < M \qquad \text{Equation 14}$$

In Equation 14, the value $QV_{qi}(j)$ represents the $j^{th}$ component of the decoding vector $QV_{qi}$. The noise shaping filter states for the next block are updated as shown in Equation 15.

$$w_{-1} = w_{M-1}$$
$$w_{-2} = w_{M-2}$$
$$w_{-3} = w_{M-3} \qquad \text{Equation 15}$$

This coding and decoding is performed for all of the N/M sub-blocks to obtain N/M indices to the decoding vector table 125. This string of indices $Q_n$, for n going from zero to N/M−1 represent identifiers for a string of decoding vectors for the residual signal $r_n$.

Thus, four parameters represent the N-point data sequence $y_n$:

1) Optimum pitch, $P_{opt}$ (8 bits),
2) Pitch filter gain, β (4 bits),
3) Scaling parameter, G (3 bits), and
4) A string of decoding table indices, $Q_n$ ($0 \leqq n < N/M$).

The parameters β and G can be coded into a single byte. Thus, only (N/M) plus 2 bytes are used to represent N samples of speech. For example, suppose nominal pitch is 100 samples long, and M=16. In this case, a frame of 96 samples of speech are represented by 8 bytes: 1 byte for $P_{opt}$, 1 byte for β and G, and 6 bytes for the decoding table indices $Q_n$. If the uncompressed speech consists of 16 bit samples, then this represents a compression of 24:1.

Back to FIG. 4, four parameters identifying the speech data are stored (block 57). In a preferred system, they are stored in a structure as described with respect to FIG. 3 where the structure of the frame can be characterized as follows:

```
#define     NumOfVectorsPerFrame (FrameSize / VectorSize)
struct      frame {
            unsigned    Gain : 4;
            unsigned    Beta : 3;
            unsigned    UnusedBit: 1;
            unsigned    char Pitch ;
            unsigned    char VQcodes[NumOfVectorsPerFrame];};
```

The diphone record of FIG. 3 utilizing this frame structure can be characterized as follows:

```
DiphoneRecord
{
        char        LeftPhone, RightPhone;
        short       LeftPitchPeriodCount,RightPitchPeriodCount;
        short       *LeftPeriods, *RightPeriods;
        struct          frame *LeftData, *RightData;
}
```

These stored parameters uniquely provide for identification of the diphones required for text-to-speech synthesis.

As mentioned above with respect to FIG. 6, the encoder continues decoding the data being encoded in order to update the filter and PBUF values. The first step involved in this is an inverse pitch filter (block 58). With the vector $r'_n$ corresponding to the decoded signal formed by concatenating the string of decoding vectors to represent the residual signal $r'_n$, the inverse filter is implemented as set out in Equation 16.

$$y'_n = r'_n + \beta * PBUF_{Pmax-Popt+n} \quad 0 \leqq n < N. \qquad \text{Equation 16}$$

Next, the pitch buffer is updated (block 59) with the output of the inverse pitch filter. The pitch buffer PBUF is updated as set out in Equation 17.

$$PBUF_n = PBUF_{(n+N)} \quad 0 \leqq n < (P_{max} - N) \qquad \text{Equation 17}$$
$$PBUF_{(Pmax-N+n)} = y'_n \quad 0 \leqq n < N$$

Finally, the linear prediction filter parameters are updated using an inverse linear prediction filter step (block 60). The output of the inverse pitch filter is passed through a first order inverse linear prediction filter to obtain the decoded speech. The difference equation to implement this filter is set out in Equation 18.

$$x'_n = 0.875 * x'_{n-1} + y'_n \qquad \text{Equation 18}$$

In Equation 18, $x'_n$ is the decompressed speech. From this, the value of $x_{-1}$ for the next frame is set to the value $x_N$ for use in the step of block 52.

FIG. 7 illustrates the decoder routine. The decoder module accepts as input (N/M)+2 bytes of data, generated by the encoder module, and applies as output N samples of speech. The value of N depends on the nominal pitch of the speech data and the value of M depends on the desired compression ratio.

In software only text-to-speech systems, the computational complexity of the decoder must be as small as possible to ensure that the text-to-speech system can run in real time even on slow computers. A block diagram of the encoder is shown in FIG. 7.

The routine starts by accepting diphone records at block 200. The first step involves parsing the parameters G, β, $P_{opt}$, and the vector quantization string $Q_n$ (block 201). Next, the residual signal $r'_n$ is decoded (block 202). This involves accessing and concatenating the decoding vectors for the vector quantization string as shown schematically at block 203 with access to the decoding quantization vector table 125.

After the residual signal $r'_n$ is decoded, an inverse pitch filter is applied (block 204). This inverse pitch filter is implemented as shown in Equation 19:

$$y'_n = r'_n + \beta * SPBUF(P_{max} - P_{opt} + n), \; 0 \leqq n < N. \qquad \text{Equation 19}$$

SPBUF is a synthesizer pitch buffer of length $P_{max}$ initialized as zero for each diphone, as described above with respect to the encoder pitch buffer PBUF.

For each frame, the synthesis pitch buffer is updated (block 205). The manner in which it is updated is shown in Equation 20:

$$SPBUF_n = SPBUF_{(n+N)} \quad 0 \leqq n < (P_{max} - N) \qquad \text{Equation 20}$$
$$SPBUF_{(Pmax-N+n)} = y'_n \quad 0 \leqq n < N$$

After updating SPBUF, the sequence $y'_n$ is applied to an inverse linear prediction filtering step (block 206). Thus, the output of the inverse pitch filter $y'_n$ is passed through a first order inverse linear prediction filter to obtain the decoded speech. The difference equation to implement the inverse linear prediction filter is set out in Equation 21:

$$x'_n = 0.875 * x'_{n-1} + y'_n \qquad \text{Equation 21}$$

In Equation 21, the vector $x'_n$ corresponds to the decompressed speech. This filtering operation can be implemented using simple shift operations without requiring any multiplication. Therefore, it executes very quickly and utilizes a very small amount of the host computer resources.

Encoding and decoding speech according to the algorithms described above, provide several advantages over prior art systems. First, this technique offers higher speech compression rates with decoders simple enough to be used in the implementation of software only text-to-speech systems on computer systems with low processing power. Second, the technique offers a very flexible trade-off between the compression ratio and synthesizer speech quality. A high-end computer system can opt for higher quality synthesized speech at the expense of a bigger RAM memory requirement.

III. Waveform Blending For Discontinuity Smoothing (FIGS. 8 and 9*a–c*)

As mentioned above with respect to FIG. 2, the synthesized frames of speech data generated using the vector quantization technique may result in slight discontinuities between diphones in a text string. Thus, the text-to-speech system provides a module for blending the diphone data frames to smooth such discontinuities. The blending technique of the preferred embodiment is shown with respect to FIGS. 8 and 9*a–c*.

Two concatenated diphones will have an ending frame and a beginning frame. The ending frame of the left diphone must be blended with the beginning frame of the right diphone without audible discontinuities or clicks being generated. Since the right boundary of the first diphone and the left boundary of the second diphone correspond to the same phoneme in most situations, they are expected to be similar looking at the point of concatenation. However, because the two diphone codings are extracted from different context, they will not look identical. This blending technique is applied to eliminate discontinuities at the point of concatenation. In FIGS. 9*a–c*, the last frame, referring here to one pitch period, of the left diphone is designated $L_n$ ($0 \leqq n < PL$) at the top of the page. The first frame (pitch period) of the right diphone is designated $R_n$ ($0 \leqq n < PR$). The blending of $L_n$ and $R_n$ according to the present invention will alter these two pitch periods only and is performed as discussed with reference to FIG. 8. The waveforms in FIGS. 9*a–c* are chosen to illustrate the algorithm, and may not be representative of real speech data.

Figure 8:
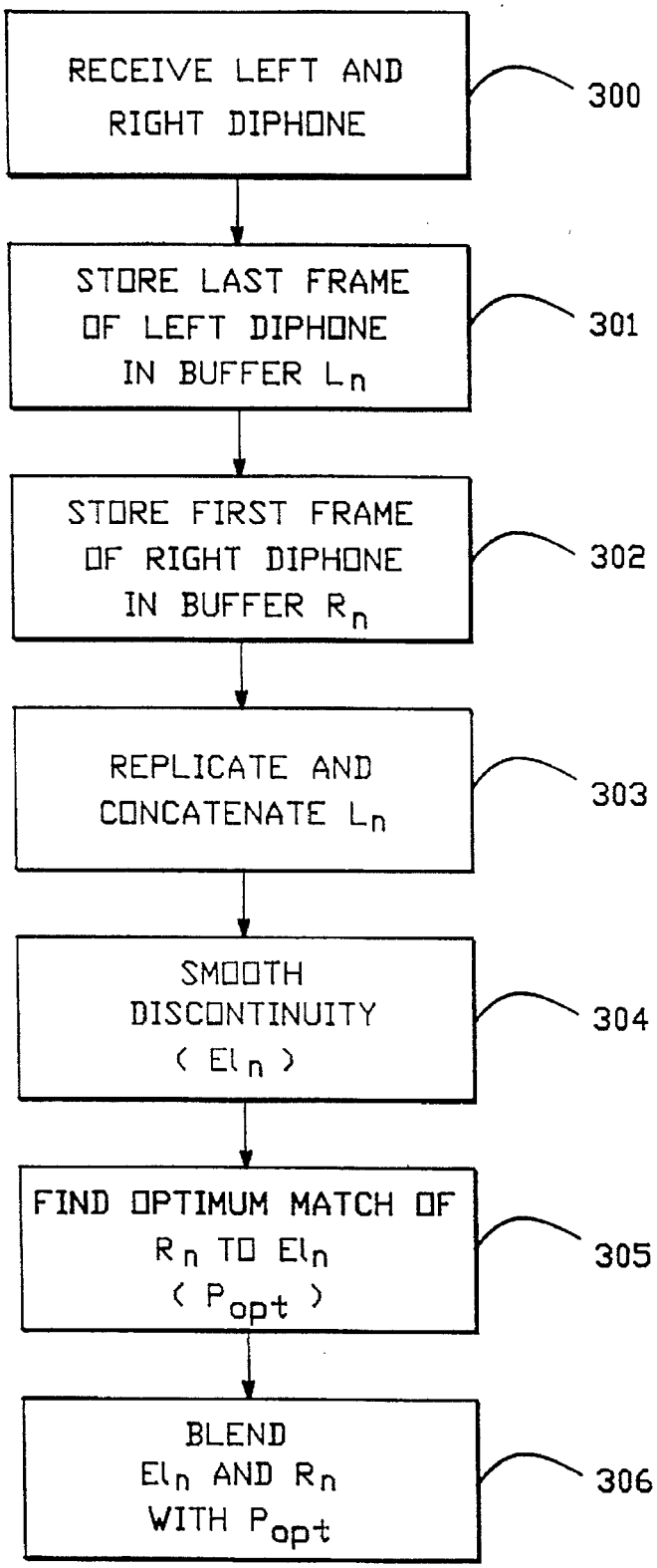
FIG. 8 is a flow chart illustrating a technique for blending the beginning and ending of adjacent diphone records.
Figure 9A:
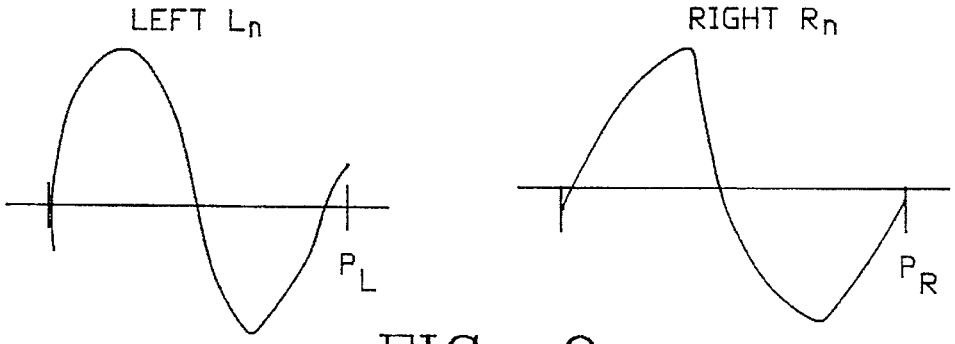
FIGS. 9*a–c* consist of a set of graphs referred to in explanation of the blending technique of FIG. 8.
Figure 9B:
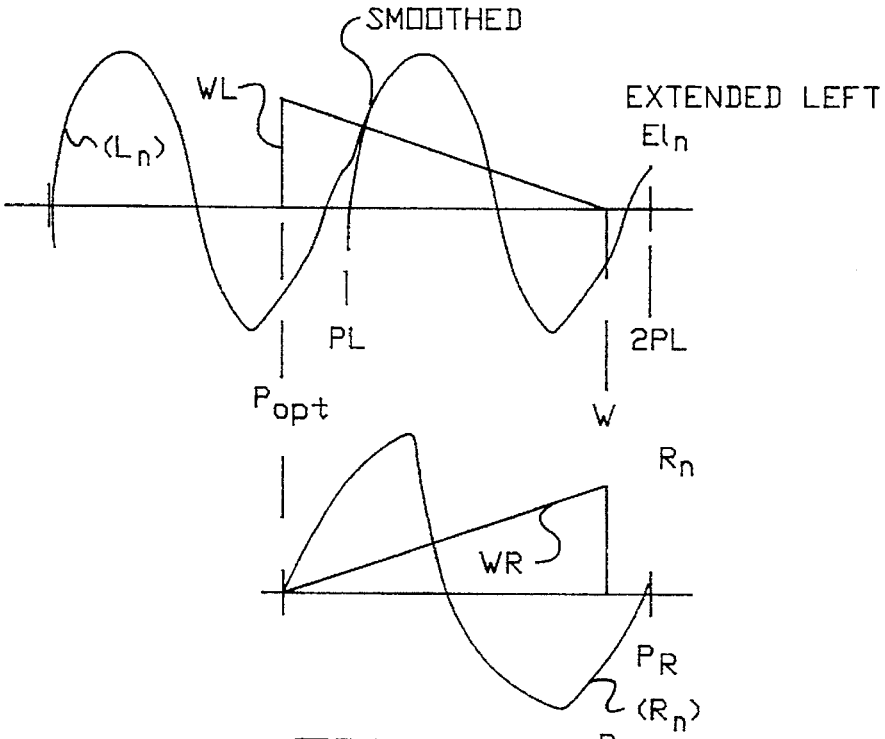
Figure 9C:
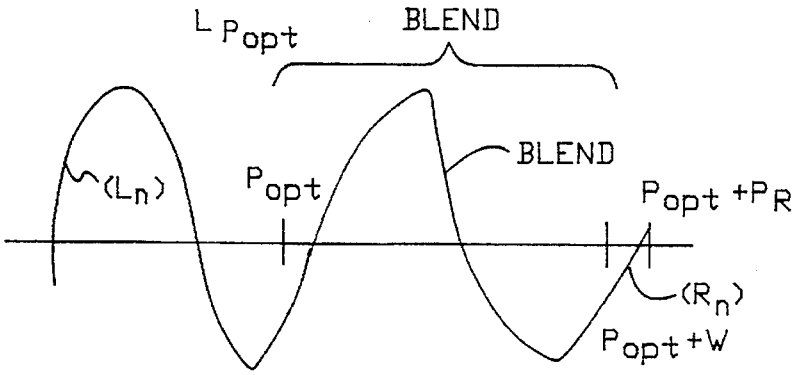

Thus, the algorithm as shown in FIG. 8 begins with receiving the left and right diphone in a sequence (block 300). Next, the last frame of the left diphone is stored in the buffer $L_n$ (block 301). Also, the first frame of the right diphone is stored in buffer $R_n$ (block 302).

Next, the algorithm replicates and concatenates the left frame $L_n$ to form extend frame (block 303). In the next step, the discontinuities in the extended frame between the replicated left frames are smoothed (block 304). This smoothed and extended left frame is referred to as $El_n$ in FIGS. 9*a–c*.

The extended sequence $El_n$ ($0 \leqq n < PL$) is obtained in the first step as shown in Equation 22:

$$El_n = L_n \qquad n = 0, 1, \ldots, PL-1 \qquad \text{Equation 22}$$
$$El_{PL+n} = L_n \qquad n = 0, 1, \ldots, PL-1$$

Then discontinuity smoothing from the point $n = P^L$ is conducted according to the filter of Equation 23:

$$El_{PL+n} = El_{PL+n} + [El_{(PL-1)} - El'_{(PL-1)}] * \Delta^{n+1}, \qquad \text{Equation 23}$$
$$n = 0, 1, \ldots, (PL/2).$$

In Equation 23, the value $\Delta$ is equal to 15/16 and $El'_{(PL-1)} = El_2 + 3*(El_1 - El_0)$. Thus, as indicated in FIGS. 9*a–c*, the extended sequence $El_n$ is substantially equal to $L_n$ on the left hand side, has a smoothed region beginning at the point $P_L$ and converges on the original shape of $L_n$ toward the point $2P_L$. If $L_n$ was perfectly periodic, then $El_{PL-1} = El_{PL-1}$.

In the next step, the optimum match of $R_n$ with the vector $El_n$ is found. This match point is referred to as $P_{opt}$ (Block 305.) This is accomplished essentially as shown in FIGS. 9*a–c* by comparing $R_n$ with $El_n$ to find the section of $El_n$ which most closely matches $R_n$. This optimum blend point determination is performed using Equation 23 where W is the minimum of PL and PR, and AMDF represents the average magnitude difference function.

$$AMDF(p) = \sum_{n=0}^{W-1} |El_{n+p} - R_n| \qquad \text{Equation 24}$$

This function is computed for values of p in the range of 0 to PL−1. The vertical bars in the operation denote the absolute value. W is the window size for the AMDF computation. $P_{opt}$ is chosen to be the value at which AMDF(p) is minimum. This means that $p = P_{opt}$ corresponds to the point at which sequences $El_{n+p}$ ($0 \leqq n < W$) and $R_n$ ($0 \leqq n < W$) are very close to each other.

After determining the optimum blend point $P_{opt}$, the waveforms are blended (block 306). The blending utilizes a first weighting ramp WL which is shown in FIGS. 9*a–c* beginning at $P_{opt}$ in the $El_n$ trace. In a second ramp, WR is shown in FIGS. 9*a–c* at the $R_n$ trace which is lined up with $P_{opt}$. Thus, in the beginning of the blending operation, the value of $El_n$ is emphasized. At the end of the blending operation, the value of $R_n$ is emphasized.

Before blending, the length PL of $L_n$ is altered as needed to ensure that when the modified $L_n$ and $R_n$ are concatenated, the waveforms are as continuous as possible. Thus, the length P'L is set to $P_{opt}$ if $P_{opt}$ is greater than PL/2. Otherwise, the length P'L is equal to $W + P_{opt}$ and the sequence $L_n$ is equal to $El_n$ for $0 \leqq n < (P'L-1)$.

The blending ramp beginning at $P_{opt}$ is set out in Equation 25:

$$R_n = El_{n+Popt} + (R_n - El_{n+Popt}) * (n+1)/W \qquad 0 \leqq n < W \qquad \text{Equation 25}$$
$$R_n = R_n \qquad W \leqq n < PR$$

Thus, the sequences $L_n$ and $R_n$ are windowed and added to get the blended $R_n$. The beginning of $L_n$ and the ending of $R_n$ are preserved to prevent any discontinuities with adjacent frames.

This blending technique is believed to minimize blending noise in synthesized speech produced by any concatenated speech synthesis.

IV. Pitch and Duration Modification (FIGS. 10, 11, 12*a–e*, 13, 14*a–c*, 15, 16*a–c*, 17, and 18*a–c*)

Figure 10:
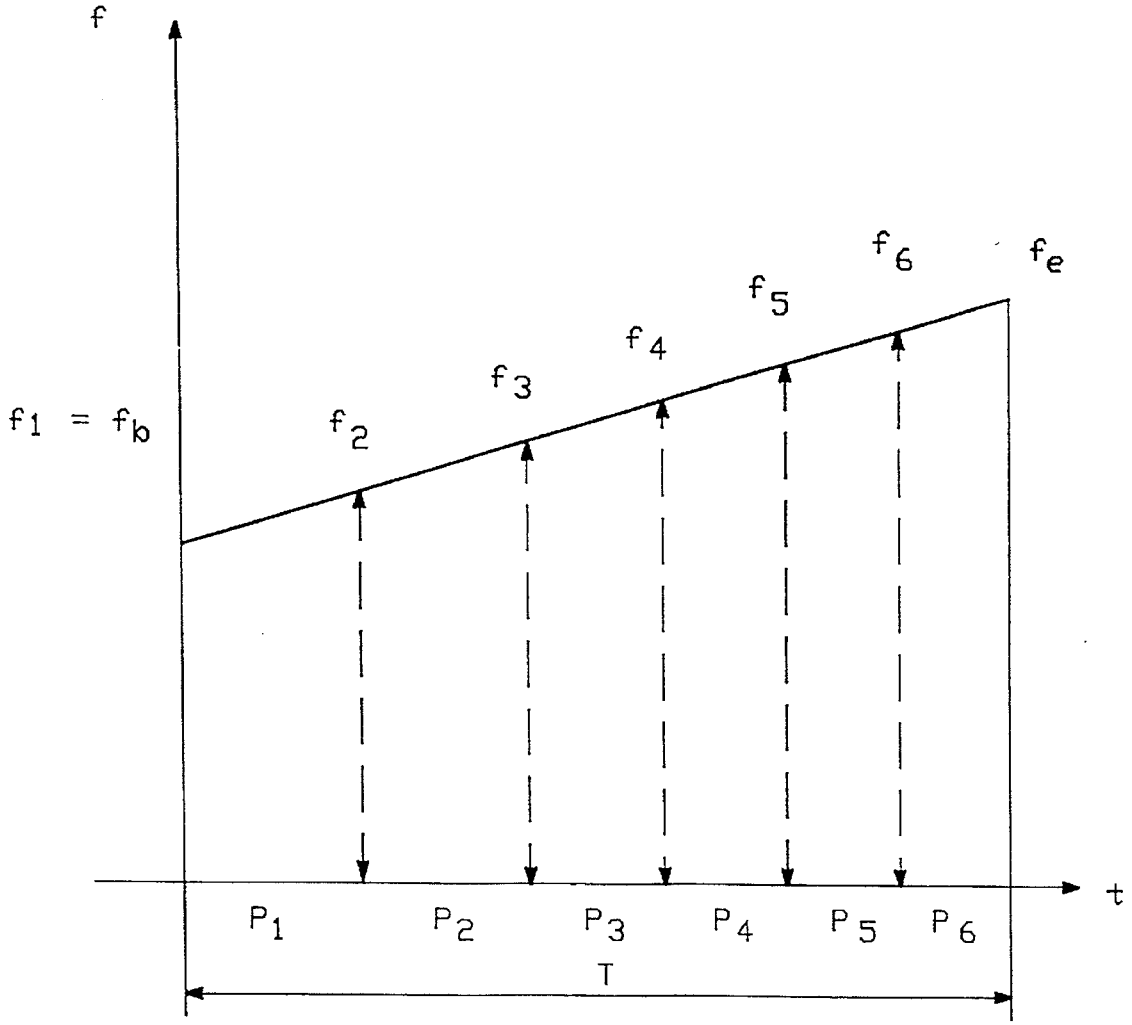
FIG. 10 is a graph illustrating a typical pitch versus time diagram for a sequence of frames of speech data.

As mentioned above with respect to FIG. 2, a text analysis program analyzes the text and determines the duration and pitch contour of each phone that needs to be synthesized and generates intonation control signals. A typical control for a phone will indicate that a given phoneme, such as AE, should have a duration of 200 milliseconds and a pitch should rise linearly from 220 Hz to 300 Hz. This requirement is graphically shown in FIG. 10. As shown in FIG. 10, T equals the desired duration (e.g. 200 milliseconds) of the phoneme. The frequency $f_b$ is the desired beginning pitch in Hz. The frequency $f_e$ is the desired ending pitch in Hz. The labels $P_1, P_2 \ldots, P_6$ indicate the number of samples of each frame to achieve the desired pitch frequencies $f_b, f_2 \ldots, f_6$. The relationship between the desired number of samples, $P_i$, and the desired pitch frequency $f_i$ ($f_1=f_b$), is defined by the relation:

$P_iF_s/f_i$, where $F_s$ is the sampling frequency for the data.

As can be seen in FIG. 10, the pitch period for a lower frequency period of the phoneme is longer than the pitch period for a higher frequency period of the phoneme. If the nominal frequency were $P_3$, then the algorithm would be required to lengthen the pitch period for frames $P_1$ and $P_2$ and decrease the pitch periods for frames $P_4$, $P_5$ and $P_6$. Also, the given duration T of the phoneme will indicate how many pitch periods should be inserted or deleted from the encoded phoneme to achieve the desired duration period. FIGS. 11, 12*a–e*, 13, 14*a–c*, 15, 16*a–c*, 17, and 18*a–c* illustrate a preferred implementation of such algorithms.

Figure 11:
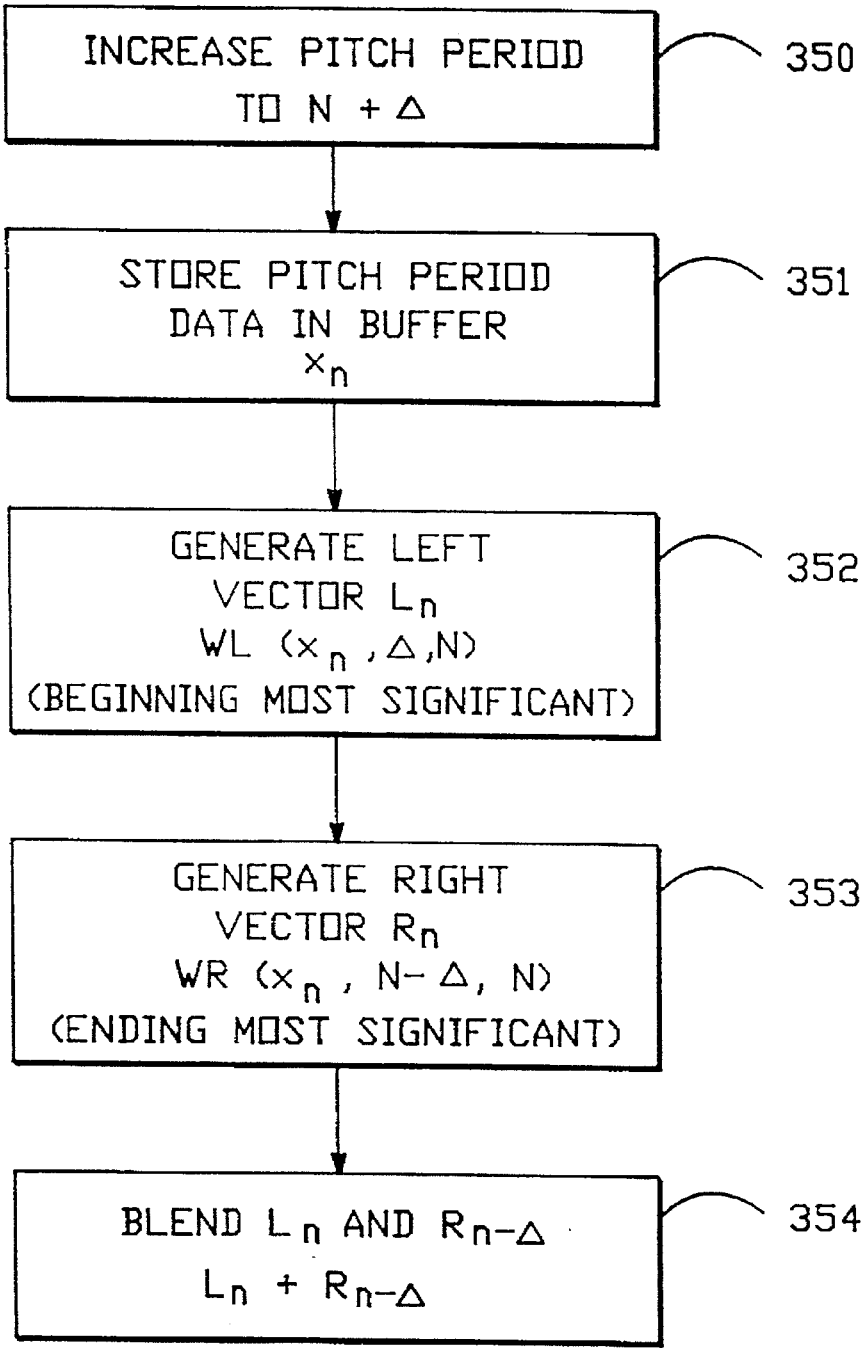
FIG. 11 is a flow chart illustrating a technique for increasing the pitch period of a particular frame.
Figure 12A:
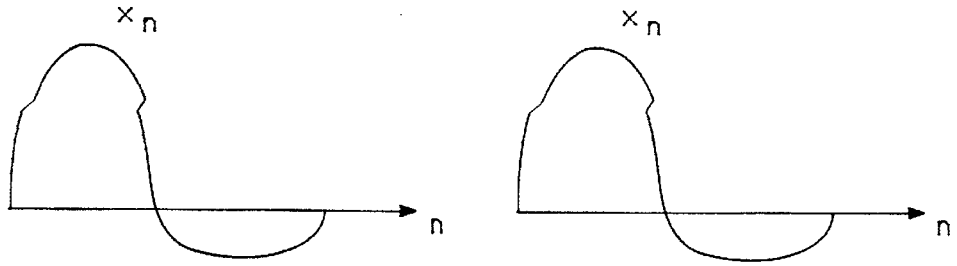
FIGS. 12*a–e* are a set of graphs referred to in explanation of the technique of FIG. 11.
Figure 12B:
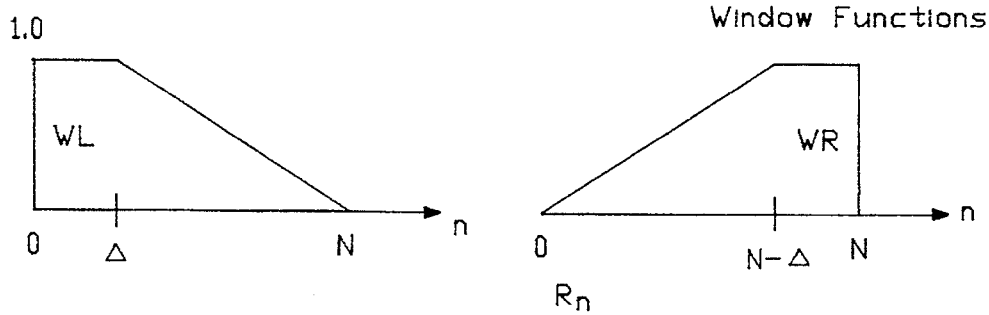
Figure 12C:
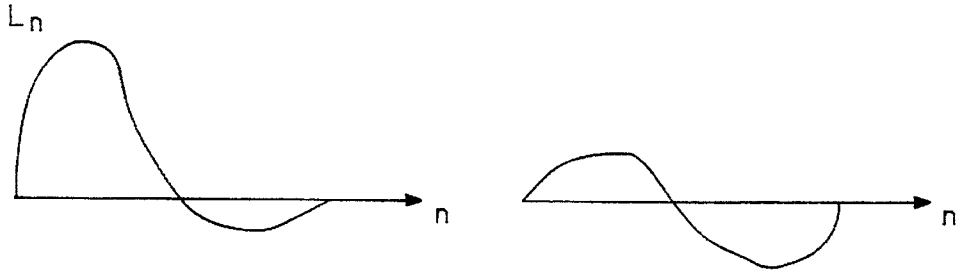
Figure 12D:
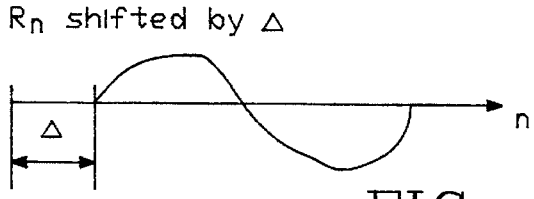
Figure 12E:
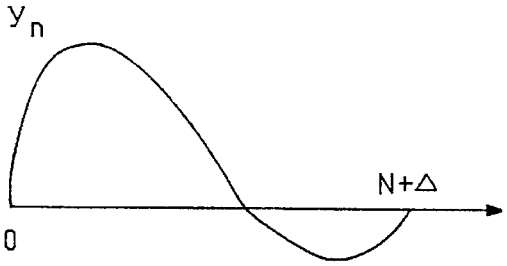

FIG. 11 illustrates an algorithm for increasing the pitch period, with reference to the graphs of FIGS. 12*a–e*. The algorithm begins by receiving a control to increase the pitch period to N+Δ, where N is the pitch period of the encoded frame. (Block 350). In the next step, the pitch period data is stored in a buffer $x_n$ (block 351). $x_n$ is shown in FIGS. 12*a–e* at the top of the page. In the next step, a left vector $L_n$ is generated by applying a weighting function WL to the pitch period data $x_n$ with reference to Δ (block 352). This weighting function is illustrated in Equation 26 where M=N−Δ:

$$L_n = x_n \quad \text{for } 0 \leqq n < \Delta$$
$$L_n = x_n * (N-n)/(M+1) \quad \text{for } \Delta \leqq n < N \qquad \text{Equation 26}$$

As can be seen in FIGS. 12*a–e*, the weighting function WL is constant from the first sample to sample Δ, and decreases from Δ to N.

Next, a weighting function WR is applied to $x_n$ (block 353) as can be seen in the FIGS. 12*a–e*. This weighting function is executed as shown in Equation 27:

$$R_n = x_{n+\Delta} * (n+1)/(M+1) \quad \text{for } 0 \leqq n < N-\Delta \qquad \text{Equation 27}$$
$$R_n = x_{n+\Delta} \quad \text{for } N-\Delta \leqq n < N.$$

As can be seen in FIGS. 12*a–e*, the weighting function WR increases from 0 to N−Δ and remains constant from N−Δ to N. The resulting waveforms $L_n$ and $R_n$ are shown conceptually in FIGS. 12*a–e*. As can be seen, $L_n$ maintains the beginning of the sequence $x_n$, while $R_n$ maintains the ending of the data $x_n$.

The pitch modified sequence $y_n$ is formed (block 354) by adding the two sequences as shown in Equation 28:

$$y_n = L_n + R_{(n-\Delta)} \qquad \text{Equation 28}$$

This is graphically shown in FIGS. 12*a–e* by placing $R_n$ shifted by Δ below $L_n$. The combination of $L_n$ and $R_n$ shifted by Δ is shown to be $y_n$ at the bottom of FIGS. 12*a–e*. The pitch period for $y_n$ is N+Δ. The beginning of $y_n$ is the same as the beginning of $x_n$, and the ending of $y_n$ is substantially the same as the ending of $x_n$. This maintains continuity with adjacent frames in the sequence, and accomplishes a smooth transition while extending the pitch period of the data.

Equation 28 is executed with the assumption that $L_n$ is 0, for n≦N, and $R_n$ is 0 for n<0. This is illustrated pictorially in FIGS. 12*a–e*.

An efficient implementation of this scheme which requires at most one multiply per sample, is shown in Equation 29:

$$y_n = x_n \quad 0 \leqq n < \Delta \qquad \text{Equation 29}$$
$$y_n = x_n + [x_{n-\Delta} - x_n]*(n-\Delta+1)/(N-\Delta+1) \quad \Delta \leqq n < N$$
$$y_n = x_{n-\Delta} \quad N \leqq n < N_d$$

This results in a new pitch period having a pitch period of N+Δ.

Figure 13:
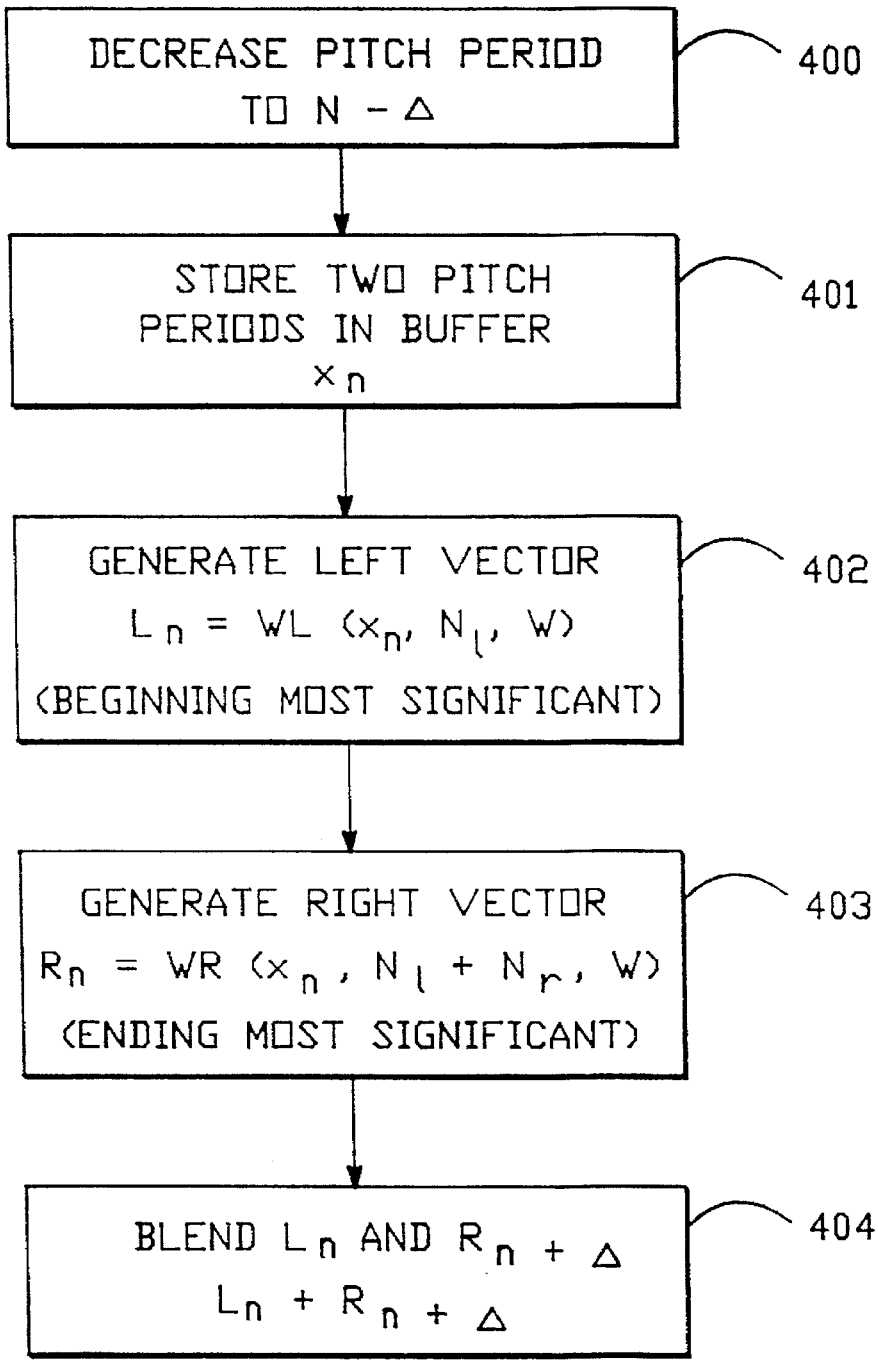
FIG. 13 is a flow chart illustrating a technique for decreasing the pitch period of a particular frame.
Figure 14A:
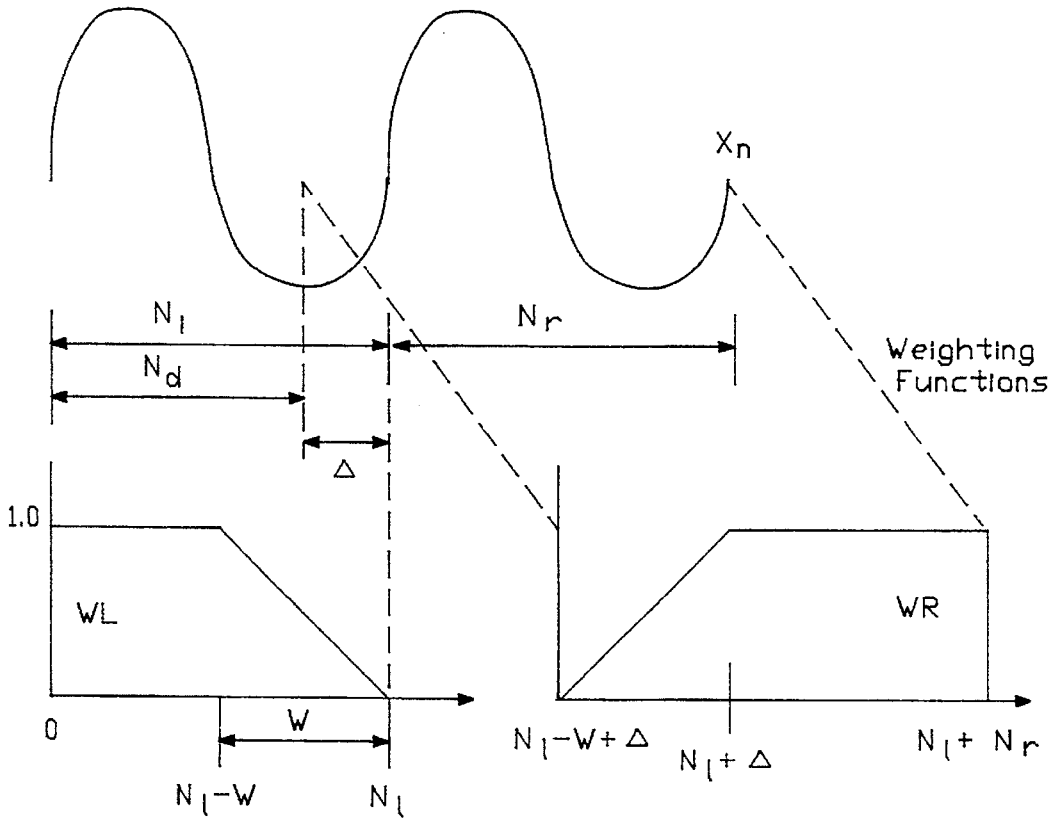
FIGS. 14*a–c* are a set of graphs referred to in explanation of the technique of FIG. 13.
Figure 14B:
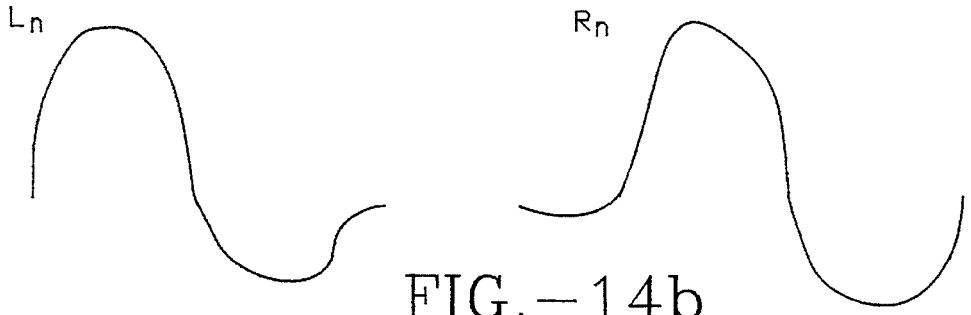
Figure 14C:
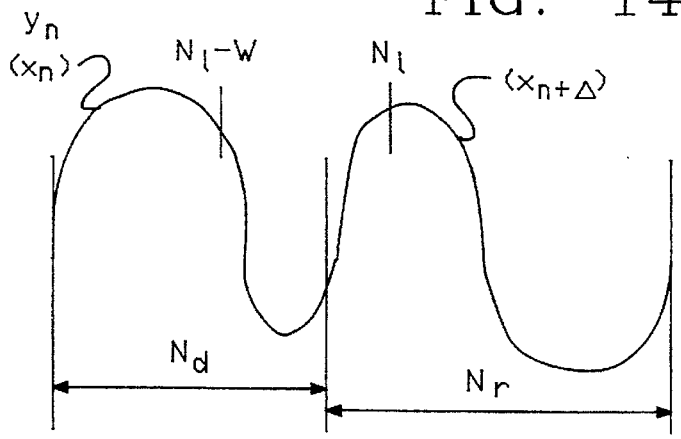

There are also instances in which the pitch period must be decreased. The algorithm for decreasing the pitch period is shown in FIG. 13 with reference to the graphs of FIGS. 14*a–c*. Thus, the algorithm begins with a control signal indicating that the pitch period must be decreased to N−Δ. (Block 400). The first step is to store two consecutive pitch periods in the buffer $x_n$ (block 401). Thus, the buffer $x_n$ as can be seen in FIGS. 14*a–c* consists of two consecutive pitch periods, with the period $N_l$ being the length of the first pitch period, and $N_r$ being the length of the second pitch period. Next, two sequences $L_n$ and $R_n$ are conceptually created using weighting functions WL and WR (blocks 402 and 403). The weighting function WL emphasizes the beginning of the first pitch period, and the weighting function WR emphasizes the ending of the second pitch period. These functions can be conceptually represented as shown in Equations 30 and 31, respectively:

$$L_n = x_n \quad \text{for } 0 \leqq n < N_l - W \qquad \text{Equation 30}$$
$$L_n = x_n * (N_l - n)/(W+1) \quad W \leqq n < N_l$$
$$L_n = 0 \quad \text{otherwise.}$$

and $$R_n = x_n * (n - N_l + W - \Delta + 1)/(W+1) \quad \text{for } N_l - W + \Delta \leqq n < N_l + \Delta \qquad \text{Equation 31}$$
$$R_n = x_n \quad \text{for } N_l + \Delta \leqq n < N_l + N_r$$
$$R_n = 0 \quad \text{otherwise.}$$

In these equations, Δ is equal to the difference between $N_l$ and the desired pitch period $N_d$. The value W is equal to 2*Δ, unless 2*Δ is greater than $N_d$, in which case W is equal to $N_d$.

These two sequences $L_n$ and $R_n$ are blended to form a pitch modified sequence $y_n$ (block 404). The length of the pitch modified sequence $y_n$ will be equal to the sum of the desired length and the length of the right phoneme frame $N_r$. It is formed by adding the two sequences as shown in Equation 32:

$$y_n = L_n + R_{(n+\Delta)} \qquad \text{Equation 32}$$

Thus, when a pitch period is decreased, two consecutive pitch periods of data are affected, even though only the length of one pitch period is changed. This is done because pitch periods are divided at places where short-term energy is the lowest within a pitch period. Thus, this strategy affects only the low energy portion of the pitch periods. This minimizes the degradation in speech quality due to the pitch modification. It should be appreciated that the drawings in FIGS. 14*a–c* are simplified and do not represent actual pitch period data.

An efficient implementation of this scheme, which requires at most one multiply per sample, is set out in Equations 33 and 34.

The first pitch period of length $N_d$ is given by Equation 33:

$$y_n = x_n \qquad 0 \leqq n < N_l - W \qquad \text{Equation 33}$$
$$y_n = x_n + [x_{n+\Delta} - x_n]*(n - N_l + W + 1)/(W + 1) \qquad N_l - W \leqq n < N_d$$

The second pitch period of length $N_r$ is generated as shown in Equation 34:

$$y_n = x_{n-\Delta} + [x_n - x_{n-\Delta}]*(n - \Delta - N_l + W + 1)/(W + 1) \qquad N_l \leqq n < N_l + \Delta \qquad \text{Equation 34}$$
$$y_n = x_n \qquad N_{l+\Delta} \leqq n < N_l + N_r$$

As can be seen in FIGS. 14*a–c,* the sequence $L_n$ is essentially equal to the first pitch period until the point $N_l$–W. At that point, a decreasing ramp WL is applied to the signal to dampen the effect of the first pitch period.

As also can be seen, the weighting function WR begins at the point $N_l$–W+Δ and applies an increasing ramp to the sequence $x_n$ until the point $N_l$+Δ. From that point, a constant value is applied. This has the effect of damping the effect of the right sequence and emphasizing the left during the beginning of the weighting functions, and generating a ending segment which is substantially equal to the ending segment of $x_n$ emphasizing the right sequence and damping the left. When the two functions are blended, the resulting waveform $y_n$ is substantially equal to the beginning of $x_n$ at the beginning of the sequence, at the point $N_l$–W a modified sequence is generated until the point $N_l$. From $N_l$ to the ending, sequence $x_n$ shifted by Δ results.

A need also arises for insertion of pitch periods to increase the duration of a given sound. A pitch period is inserted according to the algorithm shown in FIG. 15 with reference to the drawings of FIGS. 16*a–c*.

The algorithm begins by receiving a control signal to insert a pitch period between frames $L_n$ and $R_n$ (block 450). Next, both $L_n$ and $R_n$ are stored in the buffer (block 451), where $L_n$ and $R_n$ are two adjacent pitch periods of a voice diphone. (Without loss of generality, it is assumed for the description that the two sequences are of equal lengths N.)

In order to insert a pitch period, $x_n$ of the same duration, without causing a discontinuity between $L_n$ and $x_n$ and between $x_n$ and $R_n$, the pitch period $x_n$ should resemble $R_n$ around n=0 (preserving $L_n$ to $x_n$ continuity), and should resemble $L_n$ around n=N (preserving $x_n$ to $R_n$ continuity). This is accomplished by defining $x_n$ as shown in Equation 35:

$$x_n = R_n + (L_n - R_n)*[(n + 1)/(N + 1)] \qquad 0 \leqq n < N - 1 \qquad \text{Equation 35}$$

Figure 15:
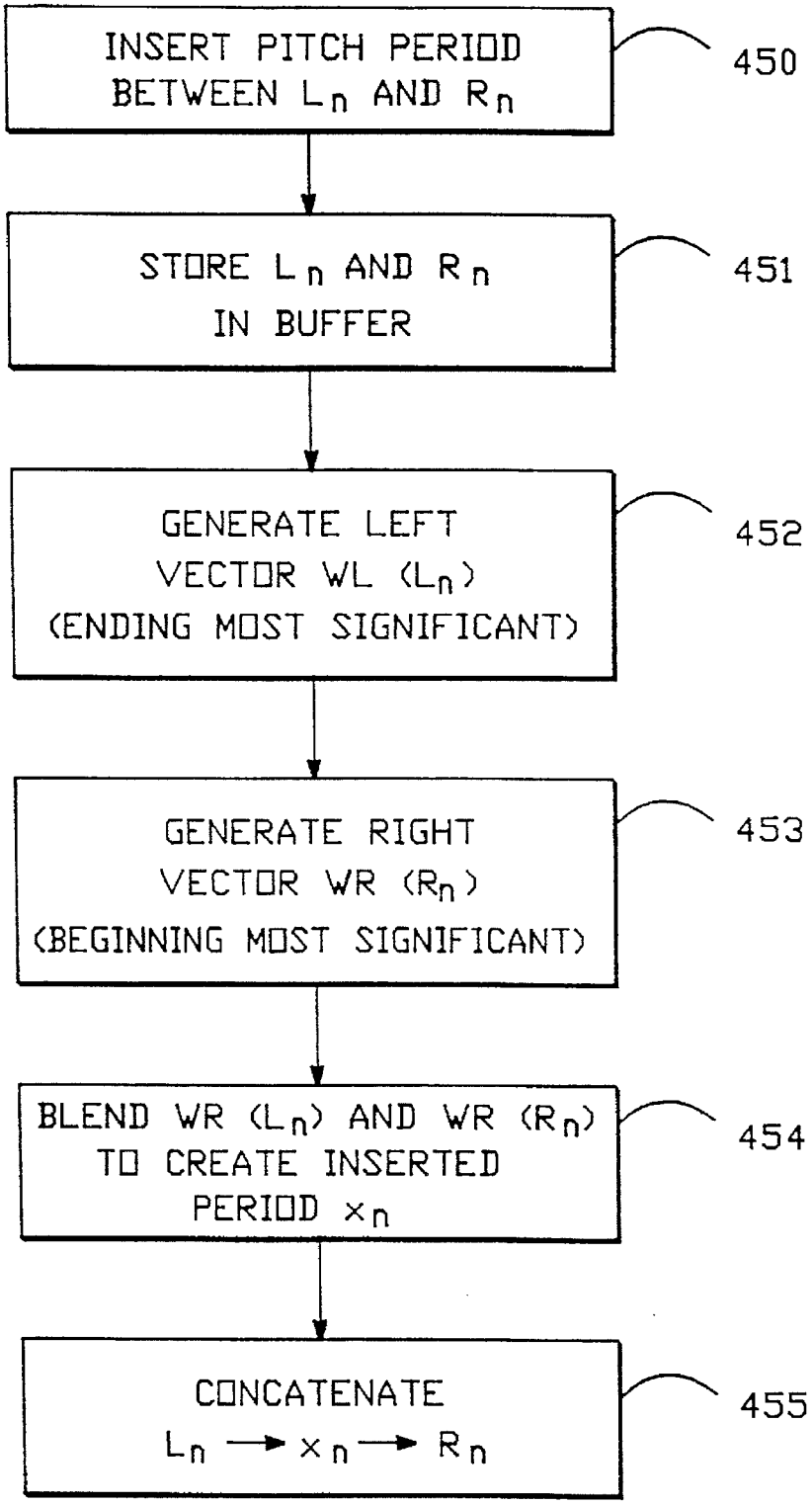
FIG. 15 is a flow chart illustrating a technique for inserting a pitch period between two frames in a sequence.

Conceptually, as shown in FIG. 15, the algorithm proceeds by generating a left vector WL($L_n$), essentially applying to the increasing ramp WL to the signal $L_n$. (Block 452).

Figure 16A:
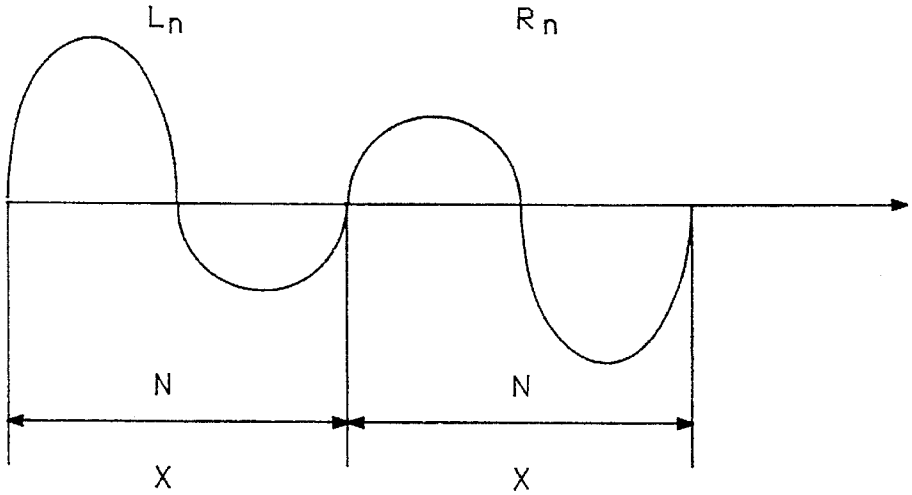
FIGS. 16*a–c* are a set of graphs referred to in explanation of the technique of FIG. 15.
Figure 16B:
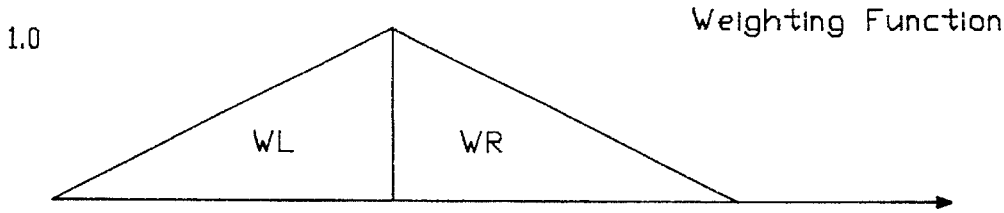
Figure 16C:
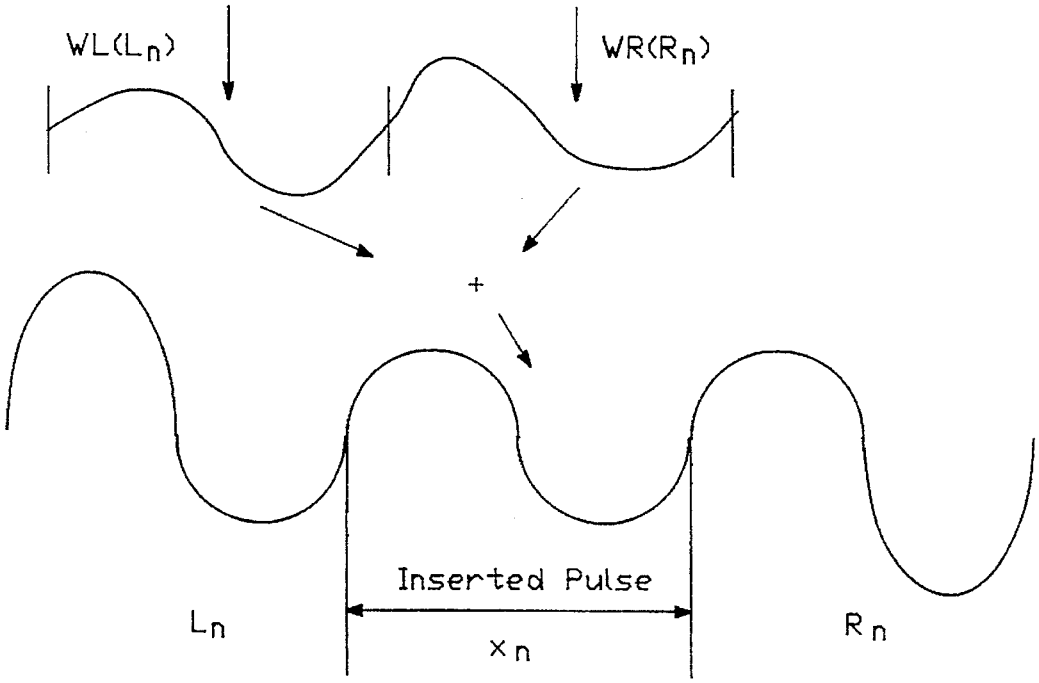

A right vector WR($R_n$) is generated using the weighting vector WR (block 453) which is essentially a decreasing ramp as shown in FIGS. 16*a–c*. Thus, the ending of $L_n$ is emphasized with the left vector, and the beginning of $R_n$ is emphasized with the vector WR.

Next, WR($L_n$) and WR($R_n$) are blended to create an inserted period $x_n$ (block 454).

The computation requirement for inserting a pitch period is thus just a multiplication and two additions per speech sample.

Finally, concatenation of $L_n$, $x_n$ and $R_n$ produces a sequence with an inserted pitch period (block 455).

Figure 17:
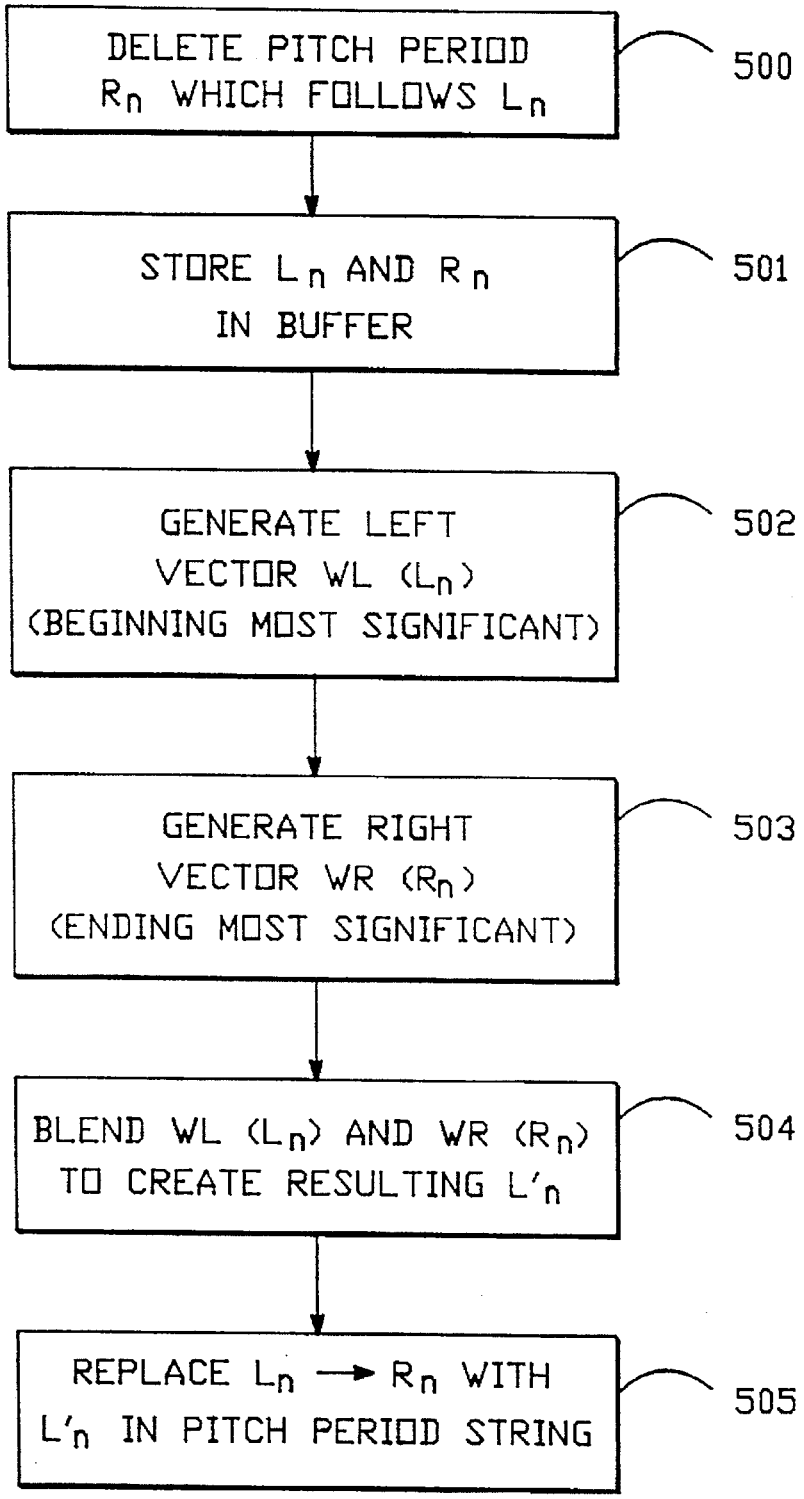
FIG. 17 is a flow chart illustrating a technique for deleting a pitch period in a sequence of frames.
Figure 18A:
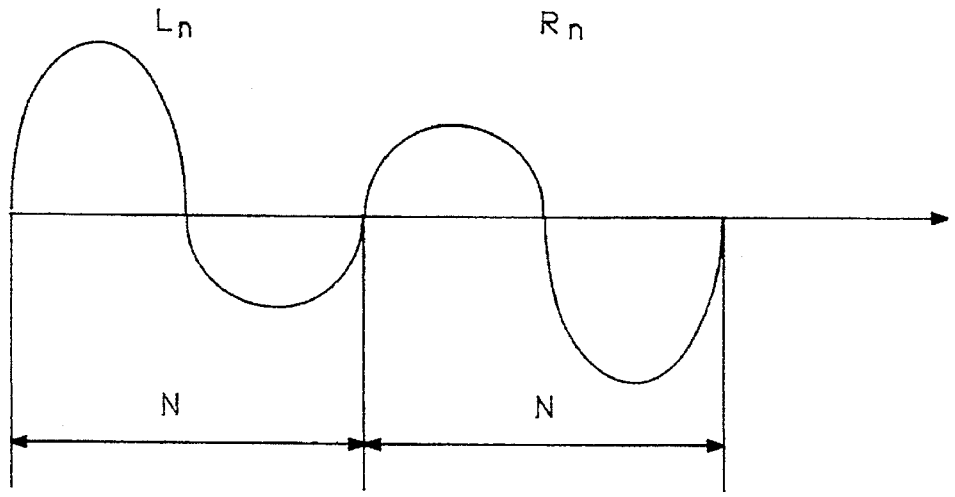
FIGS. 18*a–c* are a set of graphs referred to in explanation of the technique of FIG. 17.
Figure 18B:
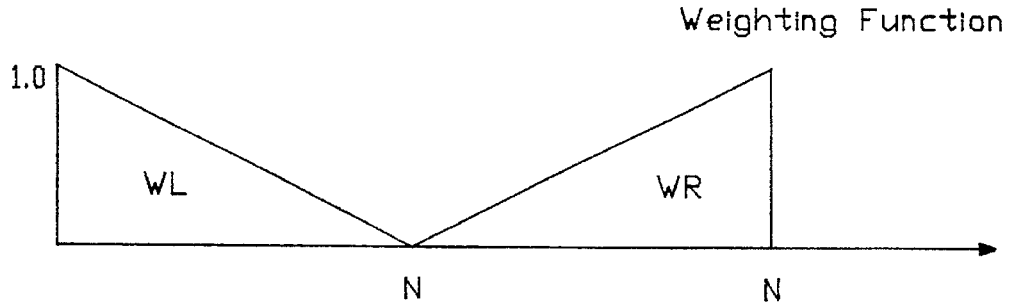
Figure 18C:
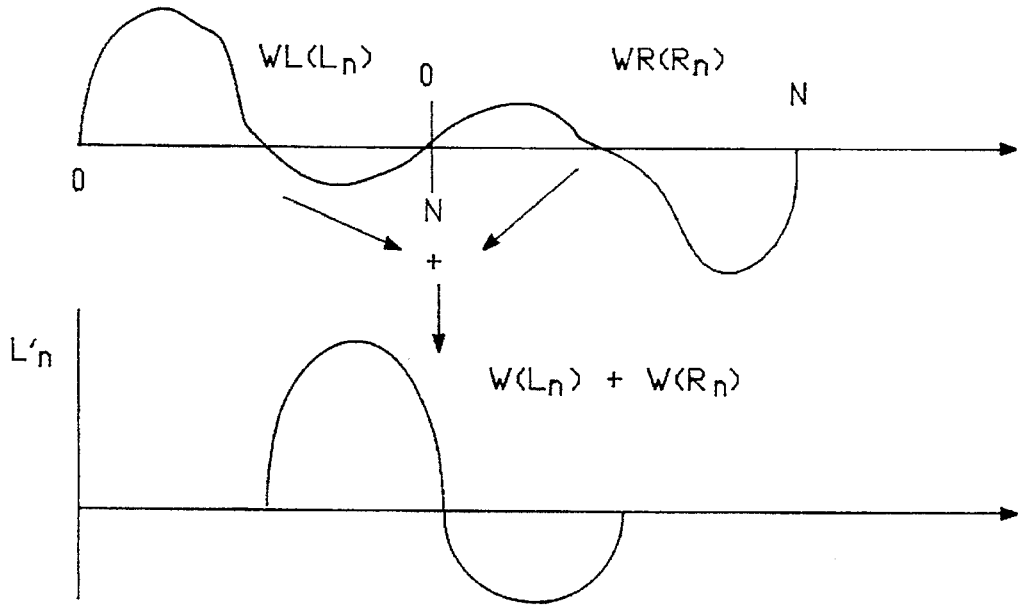

Deletion of a pitch period is accomplished as shown in FIG. 17 with reference to the graphs of FIGS. 18*a–c*. This algorithm, which is very similar to the algorithm for inserting a pitch period, begins with receiving a control signal indicating deletion of pitch period $R_n$ which follows $L_n$ (block 500). Next, the pitch periods $L_n$ and $R_n$ are stored in the buffer (block 501). This is pictorially illustrated in FIGS. 18*a–c* at the top of the page. Again, without loss of generality, it is assumed that the two sequences have equal lengths N.

The algorithm operates to modify the pitch period $L_n$ which precedes $R_n$ (to be deleted) so that it resembles $R_n$, as n approaches N. This is done as set forth in Equation 36:

$$L'_n = L_n + (R_n - L_n)*[(n + 1)/(N + 1)] \qquad 0 \leqq n < N - 1 \qquad \text{Equation 36}$$

In Equation 36, the resulting sequence $L'_n$ is shown at the bottom of FIGS. 18*a–c*. Conceptually, Equation 36 applies a weighting function WL to the sequence $L_n$ (block 502). This emphasizes the beginning of the sequence $L_n$ as shown. Next, a right vector WR($R_n$) is generated by applying a weighting vector WR to the sequence $R_n$ that emphasizes the ending of $R_n$ (block 503).

WL($L_n$) and WR($R_n$) are blended to create the resulting vector $L'_n$. (Block 504). Finally, the sequence $L_n$–$R_n$ is replaced with the sequence $L'_n$ in the pitch period string. (Block 505).

IV. Conclusion

Accordingly, the present invention presents a software only text-to-speech system which is efficient, uses a very small amount of memory, and is portable to a wide variety of standard microcomputer platforms. It takes advantage of knowledge about speech data, and to create a speech compression, blending, and duration control routine which produces very high quality speech with very little computational resources.

A source code listing of the software for executing the compression and decompression, the blending, and the duration and pitch control routines is provided in the Appendix as an example of a preferred embodiment of the present invention.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

APPENDIX

© APPLE COMPUTER, INC. 1993

37 C.F.R. §1.96(a)

COMPUTER PROGRAM LISTINGS

TABLE OF CONTENTS

| Section | | Page |
|---|---|---|
| I. | ENCODER MODULE | 33 |
| II. | DECODER MODULE | 43 |
| III. | BLENDING MODULE | 55 |
| IV. | INTONATION ADJUSTMENT MODULE | 59 |

- 33 -

I. ENCODER MODULE

```
#include <stdio.h>
#include <math.h>
#include <StdLib.h>
#include <types.h>
#include <fcntl.h>
#include <string.h>

#include <types.h>
#include <files.h>
#include <resources.h>
#include <memory.h>
#include "vqcoder.h"

#define    LAST_FRAME_FLAG          128
#define    PBUF_SIZE  440
static  float        oc_state[2], nsf_state[NSF_ORDER+1];
static  short        pstate[PORDER+1], dstate[PORDER+1];
static  short        AnaPbuf[PBUF_SIZE];

static  short        vsize, cbook_size, bs_size;

#pragma segment vqlib

/* Read Code Books */
float   *EncodeBook[MAX_CBOOK_SIZE];
short   *DecodeBook[MAX_CBOOK_SIZE];
get_cbook(short ratio)
{
   short *p;
   short    frame_size, i;
   static   short last_ratio = 0;

   Handle h;
   int      skip;
   h = GetResource('CBOK',1);
   HLock(h);
   p = (short *) *h;

   if (ratio == last_ratio)
       return;
   last_ratio = ratio;

   if (ratio < 3)
       return;
```

```
    if (NOMINAL_PITCH < 165)
        frame_size = 96;
    else
        frame_size = 160;

    get_compr_pars(ratio, frame_size, &vsize, &cbook_size, &bs_size);
    skip = 0;
    while (p[skip+1] != vsize)
    {
        short t1, t2;
        t2 = p[skip];
        t1 = p[skip+1];
        skip += sizeof(float) * (2 * t2-1) * (t1+1) / sizeof(short)
            + (2 * t2 * t1 + 2);
    }

    /*Skip Binary search tree */
    skip += sizeof(float) * (cbook_size-1) * (vsize+1) / sizeof(short)
        + (cbook_size * vsize + 2);

    /* Get pointers to Full search code books */
    for (i = 0; i < cbook_size; i++)
    {
        EncodeBook[i] = (float *) &p[skip];
        skip += (vsize+1) * sizeof (float) / sizeof(short);
    }

    for (i = 0; i < cbook_size; i++)
    {
        DecodeBook[i] = p + skip;
        skip += vsize;
    }
}

char *getcbook(long *len, short ratio)
{
    get_cbook(ratio);
    *len = sizeof(short) * vsize * cbook_size;
        /* plus one is to make space at the end for the array of pointers */
    return (char*) DecodeBook[0];
}

/* A Routine for Pitch filter parameter Estimation */
GetPitchFilterPars (x, len, pbuf, min_pitch, max_pitch, pitch, beta)
float   *beta;
short   *x, *pbuf;
short   min_pitch, max_pitch;
short   len;
```

```
unsigned int *pitch;
{
   /* Estimate long-term predictor */
   int    best_pitch, i, j;
   float  syy, sxy, best_sxy = 0.0, best_syy = 1.0;
   short  *ptr;

   best_pitch = min_pitch;
   ptr = pbuf + PBUF_SIZE - min_pitch;
   syy = 1.0;
   for (i = 0; i < len; i++)
   {
            syy += (*ptr) * (*ptr);
            ptr++;
    }
   for (j = min_pitch; j < max_pitch; j++)
   {
       sxy = 0.0;
       ptr = pbuf + PBUF_SIZE - j;
       for (i = 0; i < len; i++)
           sxy += x[i] * (*ptr++);

       if (sxy > 0 && (sxy * sxy * best_syy > best_sxy * best_sxy * syy))
       {
           best_syy = syy;
           best_sxy = sxy;
           best_pitch = j;
       }
       syy = syy - pbuf[PBUF_SIZE - j + len - 1] * pbuf[PBUF_SIZE - j + len - 1]
                + pbuf[PBUF_SIZE - j - 1] * pbuf[PBUF_SIZE - j - 1];
   }

   *pitch = best_pitch;
   *beta = best_sxy / best_syy;
}

/* Quantization of LTP gain parameter */
CodePitchFilterGain(beta, bcode)
float beta;
unsigned int *bcode;
{
   int i;
   for (i = 0; i < DLB_TAB_SIZE; i++)
   {
      if (beta <= dlb_tab[i])
         break;
   }
   *bcode = i;
```

- 36 -

```
}

/* Pitch filter */
PitchFilter(data, len, pbuf, pitch, ibeta)
float   *data;
short   ibeta;
short   *pbuf;
short       len;
unsigned int pitch;
{

  long          pn;
  int       i, j;


   j = PBUF_SIZE - pitch;
   for (i = 0; i < len; i++)
   {
       pn  = ((ibeta * pbuf[j++]) >> 4);
       data[i] -= pn;
   }
}

/* Forward Noise Shaping filter */
FNSFilter(float *inp, float *state, short len, float *out)
{
   short i, j;
   for (j = 0; j < len; j++)
   {
       float tmp = inp[j];
       for (i = 1; i <= NSF_ORDER; i++)
           tmp += state[i] * nsf[i];
       out[j] = state[0] = tmp;
       for (i = NSF_ORDER; i > 0; i--)
           state[i] = state[i-1];
   }
}

/* Update Noise shaping Filter states */
UpdateNSFState(float *inp, float *state, short len)
{
   short i, j;
   float     temp_state[NSF_ORDER+1];

   for (i = 0; i <= NSF_ORDER; i++)
       temp_state[i] = 0;

   for (j = 0; j < len; j++)
```

```
    {
        float tmp = inp[j];
        for (i = 1; i <= NSF_ORDER; i++)
            tmp += temp_state[i] * nsf[i];
        temp_state[0] = tmp;
        for (i = NSF_ORDER; i > 0; i--)
            temp_state[i] = temp_state[i-1];
    }
    for (i = 0; i <= NSF_ORDER; i++)
        state[i] = state[i] - temp_state[i];
}

/* Quantization of Segment Power */
CodeBlockGain(power, gcode)
float power;
unsigned int *gcode;
{
    int i;
    for (i = 0; i < DLG_TAB_SIZE; i++)
    {
       if (power <= dlg_tab[i])
          break;
    }
    *gcode = i;
}

/* Full search Coder */
VQCoder(float *x, float *nsf_state, short len, struct frame *bs)
{
    float           max_x, tmp;
    int         i, j, k, index, lshift_count;
    unsigned int    gcode;
    float           min_err = 0;

    max_x = x[0];
    for (i = 1; i < len; i++)
        if ( fabs(x[i]) > max_x)
            max_x = fabs(x[i]);

    CodeBlockGain(max_x, &gcode);
    max_x = qlg_tab[gcode];
    lshift_count = 7 - gcode;          /* To scale 14-bit Code book output to the 16-bit
actual value */
    bs->gcode = gcode;

    for (i = 0; i < len; i += vsize)
    {
        /* Filter the data vector */
```

```
        FNSFilter(&x[i], nsf_state, vsize, &x[i]);

        /* Scale data */
        for (j = i; j < i + vsize; j++)
            x[j] = x[j] * 1024 / max_x;

        index = 0;
        for (j = 0; j < cbook_size; j++)
        {
            tmp = EncodeBook[j][vsize] * 1024.0;
            for (k = 0; k < vsize; k++)
                tmp -= x[i+k] * EncodeBook[j][k];

            if (tmp < min_err || j == 0)
            {
                index = j;
                min_err = tmp;
            }
        }
        bs->vqcode[i/vsize] = index;

        /* Rescale data: Decoded data is 14-bits, convert to 16 bits */
        if (lshift_count)
        {
            for (k = 0; k < vsize; k++)
                x[i+k] = ((4 * DecodeBook[index][k]) >> lshift_count);
        }
        else
        {
            for (k = 0; k < vsize; k++)
                x[i+k] = 4 * DecodeBook[index][k];
        }

        /* Update noise shaping filter state */
        UpdateNSFState(&x[i], nsf_state, vsize);
    }
}

init_compress()
{
    int i;
    oc_state[0] = 0;;
    oc_state[1] = 0;;
    for (i = 0; i <= PORDER; i++)
        pstate[i] = dstate[i] = 0;
    for (i = 0; i < PBUF_SIZE; i++)
        AnaPbuf[i] = 0;
    for (i=0; i <= NSF_ORDER; i++)
```

```
        nsf_state[i] = 0;
}

Encoder(xn, frame_size, min_pitch, max_pitch, bs)
short xn[];
struct frame *bs;
short   frame_size, min_pitch, max_pitch;
{
   unsigned int pitch, bcode;
   float     preemp_xn[PBUF_SIZE], beta;
   short     xn_copy[PBUF_SIZE];
   short     ibeta;
   float     acc;
   int i, j;


 /* Offset Compensation */
   for (i = 0; i < frame_size; i++)
   {
        float inp = xn[i];
        xn[i] = inp - oc_state[0] + ALPHA * oc_state[1];
        oc_state[1] = xn[i];
        oc_state[0] = inp;
   }

   /* Linear Prediction Filtering */
   for (i = 0; i < frame_size; i++)
   {
        acc = pstate[0] = xn[i];
        for (j = 1; j <= PORDER; j++)
             acc -= pstate[j] * pfilt[j];
        xn_copy[i] = preemp_xn[i] = acc;
        for (j = PORDER; j > 0; j--)
             pstate[j] = pstate[j-1];
   }

   GetPitchFilterPars (xn_copy, frame_size, AnaPbuf, min_pitch,
        max_pitch, &pitch, &beta);
   CodePitchFilterGain(beta, &bcode);
   ibeta = qlb_tab[bcode];

   bs->bcode = bcode;
   bs->pitch = pitch - min_pitch + 1;

   PitchFilter(preemp_xn, frame_size, AnaPbuf, pitch, ibeta);

   VQCoder(preemp_xn, nsf_state, frame_size, bs);
```

```
    /* Inverse Filtering */
    j = PBUF_SIZE - pitch;
    for (i = 0; i < frame_size; i++)
    {
        xn_copy[i] = preemp_xn[i];
        xn_copy[i] += ((ibeta * AnaPbuf[j++]) >> 4);
    }

    /* Update Pitch Buffer */
    j = 0;
    for (i = frame_size; i < PBUF_SIZE; i++)
        AnaPbuf[j++] = AnaPbuf[i];
    for (i = 0; i < frame_size; i++)
        AnaPbuf[j++] = xn_copy[i];

    /* Inverse LP filtering  */
    for (i = 0; i < frame_size; i++)
    {
        acc = xn_copy[i];
        for (j = 1; j <= PORDER; j++)
            acc = acc + dstate[j] * pfilt[j];
        dstate[0] = acc;
        for (j = PORDER; j > 0; j--)
            dstate[j] = dstate[j-1];
    }

    for (j = 0; j <= PORDER; j++)
        pstate[j] = dstate[j];
}

compress (short *input, short ilen, unsigned char *output, long *olen, long docomp)
{
    int             i, j, vcount;
    unsigned char   temp;
    short           frame_size, min_pitch, max_pitch;

    if (docomp > 2)
    {
        init_compress();

        if (NOMINAL_PITCH < 165)
        {
            min_pitch = 96;
            frame_size = 96;
            max_pitch = 350;
        }
        else
        {
```

- 41 -

```
            min_pitch = 160;
            frame_size = 160;
            max_pitch = 414;
        }

        bs_size = frame_size / vsize + 2;
        /* TEMPORARY: Storing State information */
        pstate[1] = *(input - 1);
        if (pstate[1] > 0)
            pstate[1] = (pstate[1] + 128) / 256 + 128;
        else
            pstate[1] = (pstate[1] - 128) / 256 + 128;

        if (pstate[1] < 0)
            pstate[1] = 0;
        if (pstate[1] > 255)
            pstate[1] = 255;
        *output = pstate[1];
        j = 1;
        pstate[1] = pstate[1] - 128;
        pstate[1] = 256 * pstate[1];
        dstate[1] = pstate[1];
        /* End of Hack */
        for (i = 0; i < ilen; i += frame_size)
        {
            Encoder(input+i, frame_size, min_pitch, max_pitch, output+j);
            j += bs_size;
        }
        j -= bs_size;

        /* Number of vectors in last frame */
        vcount = (ilen + frame_size - i + vsize - 1) / vsize;
        temp = output[j];
        output[j] = vcount + LAST_FRAME_FLAG;
        output[j + vcount + 2] = temp;
        *olen = j + vcount + 3;
    }
    else
    {
        static long SampCount = 0;
        copy(input, output, 2*ilen);
        SampCount += ilen;
        *olen = ilen;
    }
}

copy(a, b, len)
short  *a, *b;
```

- 42 -

```
short  len;
{
   int i;
   for (i = 0; i < len; i++)
        *b++ = (*a++);
}
```

- 43 -

II. DECODER MODULE

```
#include <Types.h>
#include <Memory.h>
#include <Quickdraw.h>
#include <ToolUtils.h>
#include <errors.h>
#include <files.h>

#include "vtcint.h"
#include <stdlib.h>
#include <math.h>
#include <sysequ.h>
#include <string.h>

#define MAX_CBOOK_SIZE          256
#define    LAST_FRAME_FLAG      128
#define    PORDER                   1
#define    IPCONS                   7                    /* 7/8 */

#define    LARGE_NUM                100000000
#define    VOICED     1

#define LEFT                  0
#define    RIGHT                1
#define    UNVOICED             0

#define    PFILT_ORDER              8

struct frame {
 unsigned  gcode : 4;
 unsigned      bcode : 4;
 unsigned pitch : 8;
 unsigned char vqcode[];
};

void expand(short **DecodeBook, short frame_size, short vsize,
   short min_pitch, struct frame *bs, short *output, short smpnum);

get_compr_pars(short ratio, short frame_size, short *vsize,
   short *cbook_size, short *bs_size)
{
   switch (ratio)
   {
       case 4:
           *vsize = 2;
           *cbook_size = 256;
```

```
            *bs_size = frame_size/2 + 2;
            break;
        case 7:
            *vsize = 4;
            *cbook_size = 256;
            *bs_size = frame_size/4 + 2;
            break;
        case 14:
            *vsize = 8;
            *cbook_size = 256;
            *bs_size = frame_size/8 + 2;
            break;
        case 24:
            *vsize = 16;
            *cbook_size = 256;
            *bs_size = frame_size/16 + 2;
            break;
        default:
            *vsize = 2;
            *cbook_size = 256;
            *bs_size = frame_size/2 + 2;
            break;
    }
}

short *SnInit(short comp_ratio)
{
    short *state, *ptr;
    int i;

    state = ptr = (short*)NewPtr((PFILT_ORDER+1 + PFILT_ORDER/2 + 2) *
sizeof(short));
    if ( state == nil )
    {
        return nil;
    }
    for (i=0;i<PFILT_ORDER+1;i++)
        *ptr++ = 0;
/*
    if (comp_ratio == 24)
    {
        *ptr++ = 0.036953 * 32768 + 0.5;
        *ptr++ = -0.132232 * 32768 - 0.5;
        *ptr++ = 0.047798 * 32768 + 0.5;
        *ptr++ = 0.403220 * 32768 + 0.5;
        *ptr++ = 0.290033 * 32768 + 0.5;
    }
    else
```

```
    {
        *ptr++ = 0.074539 * 32768 + 0.5;
        *ptr++ = -0.174290 * 32768 - 0.5;
        *ptr++ = 0.013704 * 32768 + 0.5;
        *ptr++ = 0.426815 * 32768 + 0.5;
        *ptr++ = 0.320707 * 32768 + 0.5;
    }
*/
    if (comp_ratio == 24)
    {
        *ptr++ = 1211;
        *ptr++ = -4333;
        *ptr++ = 1566;
        *ptr++ = 13213;
        *ptr++ = 9504;
    }
    else
    {
        *ptr++ = 2442;
        *ptr++ = -5711;
        *ptr++ = 449;
        *ptr++ = 13986;
        *ptr++ = 10509;
    }
    *ptr = 0;        /* DC value */
    return state;
}

SnDone(char *state)
{
    if ( state != nil )
    {
        DisposPtr(state);
    }
}

short **SnDeInit(p, ratio, frame_size)
short *p,ratio, frame_size;
{
    int i;
    short cbook_size = 256, vsize = 16, bs_size;
    short **DecodeBook;

    get_compr_pars(ratio, frame_size, &vsize, &cbook_size, &bs_size);

    DecodeBook = (short**)NewPtr(cbook_size * sizeof(short*));
    if (DecodeBook) {
        for (i = 0; i < cbook_size; i++)
```

```
        {
            DecodeBook[i] = p;
            p += vsize;
        }
    }
    return DecodeBook;
}

SnDeDone(char *DecodeBook)
{
    if ( DecodeBook != nil )
    {
        DisposPtr(DecodeBook);
    }
}

void
expand(short **DecodeBook, short frame_size, short vsize,
    short min_pitch, struct frame *bs, short *output, short smpnum)
{
    short    count;
    short    *bptr, *sptr1, *sptr2;
    unsigned short pitch, bcode;
/*
    short qlb_tab[] = {
    1, 2, 3, 4, 5, 6, 7, 8,
    9, 10, 11, 12, 13, 14, 15, 16
    };
*/
    bcode = bs->bcode;
    pitch = bs->pitch + min_pitch - 1;

    /* Decode VQ vectors */
    {
        unsigned    char    *cptr;
        short    k, vsize_by_2;
        short    rshift_count = 7 - bs->gcode;    /* We want the output to be 14-bit
number */

        sptr1 = output + smpnum;
        cptr = bs->vqcode;
        vsize_by_2 = (vsize >> 1) + 1; /* +1 since we do a while (--i) instead of
while (i--) */
        if (rshift_count)
        {
            for (k = 0; k < frame_size; k += vsize)
            {
                bptr = DecodeBook[*cptr++];
```

```
                count = vsize_by_2;
                while (--count)
                {
                    *sptr1++ = ((*bptr++) >> rshift_count);
                    *sptr1++ = ((*bptr++) >> rshift_count);
                }
            }
        }
        else
        {
            for (k = 0; k < frame_size; k += vsize)
            {
                bptr = DecodeBook[*cptr++];
                count = vsize_by_2;
                while (--count)
                {
                    *sptr1++ = *bptr++;
                    *sptr1++ = *bptr++;
                }
            }
        }
    }

    /* Inverse Filtering */
    if (smpnum < pitch)
    {
        sptr1 = output + pitch;
        count = smpnum + frame_size + 1 - pitch; /* +1 since we do a while (--i)
instead of while (i--) */
        sptr2 = sptr1 - pitch;
        switch (bcode)
        {
            case 0:
                while (--count)
                    *sptr1++ += ((*sptr2++) >> 4);
                break;
            case 1:
                while (--count)
                    *sptr1++ += ((*sptr2++) >> 3);
                break;
            case 2:
                while (--count)
                    *sptr1++ += ((3 * (*sptr2++)) >> 4);
                break;
            case 3:
                while (--count)
                    *sptr1++ += ((*sptr2++) >> 2);
                break;
```

```
case 4:
    while (--count)
        *sptr1++ += ((5 * (*sptr2++)) >> 4);
    break;
case 5:
    while (--count)
        *sptr1++ += ((3 * (*sptr2++)) >> 3);
    break;
case 6:
    while (--count)
        *sptr1++ += ((7 * (*sptr2++)) >> 4);
    break;
case 7:
    while (--count)
        *sptr1++ += ((*sptr2++) >> 1);
    break;
case 8:
    while (--count)
    {
        long    tmp;
        tmp = *sptr2++;
        *sptr1++ += (((tmp << 3) + tmp) >> 4);
    }
    break;
case 9:
    while (--count)
        *sptr1++ += ((5 * (*sptr2++)) >> 3);
    break;
case 10:
    while (--count)
    {
        long    tmp;
        tmp = *sptr2++;
        *sptr1++ += (((tmp << 3) + 3 * tmp) >> 4);
    }
    break;
case 11:
    while (--count)
        *sptr1++ += ((3 * (*sptr2++)) >> 2);
    break;
case 12:
    while (--count)
    {
        long    tmp;
        tmp = *sptr2++;
        *sptr1++ += (((tmp << 4) - 3 * tmp) >> 4);
    }
    break;
```

```
        case 13:
            while (--count)
                *sptr1++ += ((7 * (*sptr2++)) >> 3);
            break;
        case 14:
            while (--count)
            {
                long    tmp;
                tmp = *sptr2++;
                *sptr1++ += (((tmp << 4) - tmp) >> 4);
            }
            break;
        case 15:
            while (--count)
                *sptr1++ += *sptr2++;
            break;
    }
} else {
    sptr1 = output + smpnum;
    sptr2 = sptr1 - pitch;
    count = (frame_size / 4) + 1;
    switch (bcode)
    {
        case 0:
            while (--count) {
                *sptr1++ += ((*sptr2++) >> 4);
                *sptr1++ += ((*sptr2++) >> 4);
                *sptr1++ += ((*sptr2++) >> 4);
                *sptr1++ += ((*sptr2++) >> 4);
            }
            break;
        case 1:
            while (--count) {
                *sptr1++ += ((*sptr2++) >> 3);
                *sptr1++ += ((*sptr2++) >> 3);
                *sptr1++ += ((*sptr2++) >> 3);
                *sptr1++ += ((*sptr2++) >> 3);
            }
            break;
        case 2:
            while (--count) {
                *sptr1++ += ((3 * (*sptr2++)) >> 4);
                *sptr1++ += ((3 * (*sptr2++)) >> 4);
                *sptr1++ += ((3 * (*sptr2++)) >> 4);
                *sptr1++ += ((3 * (*sptr2++)) >> 4);
            }
            break;
        case 3:
```

- 50 -

```
        while (--count) {
            *sptr1++ += ((*sptr2++) >> 2);
            *sptr1++ += ((*sptr2++) >> 2);
            *sptr1++ += ((*sptr2++) >> 2);
            *sptr1++ += ((*sptr2++) >> 2);
        }
        break;
    case 4:
        while (--count) {
            *sptr1++ += ((5 * (*sptr2++)) >> 4);
            *sptr1++ += ((5 * (*sptr2++)) >> 4);
            *sptr1++ += ((5 * (*sptr2++)) >> 4);
            *sptr1++ += ((5 * (*sptr2++)) >> 4);
        }
        break;
    case 5:
        while (--count) {
            *sptr1++ += ((3 * (*sptr2++)) >> 3);
            *sptr1++ += ((3 * (*sptr2++)) >> 3);
            *sptr1++ += ((3 * (*sptr2++)) >> 3);
            *sptr1++ += ((3 * (*sptr2++)) >> 3);
        }
        break;
    case 6:
        while (--count) {
            *sptr1++ += ((7 * (*sptr2++)) >> 4);
            *sptr1++ += ((7 * (*sptr2++)) >> 4);
            *sptr1++ += ((7 * (*sptr2++)) >> 4);
            *sptr1++ += ((7 * (*sptr2++)) >> 4);
        }
        break;
    case 7:
        while (--count) {
            *sptr1++ += ((*sptr2++) >> 1);
            *sptr1++ += ((*sptr2++) >> 1);
            *sptr1++ += ((*sptr2++) >> 1);
            *sptr1++ += ((*sptr2++) >> 1);
        }
        break;
    case 8:
        while (--count) {
            long    tmp;
            tmp = *sptr2++;
            *sptr1++ += ((8 * tmp + tmp) >> 4);
            tmp = *sptr2++;
            *sptr1++ += ((8 * tmp + tmp) >> 4);
            tmp = *sptr2++;
            *sptr1++ += ((8 * tmp + tmp) >> 4);
```

```
            tmp = *sptr2++;
            *sptr1++ += ((8 * tmp + tmp) >> 4);
        }
        break;
    case 9:
        while (--count) {
            *sptr1++ += ((5 * (*sptr2++)) >> 3);
            *sptr1++ += ((5 * (*sptr2++)) >> 3);
            *sptr1++ += ((5 * (*sptr2++)) >> 3);
            *sptr1++ += ((5 * (*sptr2++)) >> 3);
        }
        break;
    case 10:
        while (--count) {
            long tmp;
            tmp = *sptr2++;
            *sptr1++ += (((tmp << 3) + 3 * tmp) >> 4);
            tmp = *sptr2++;
            *sptr1++ += (((tmp << 3) + 3 * tmp) >> 4);
            tmp = *sptr2++;
            *sptr1++ += (((tmp << 3) + 3 * tmp) >> 4);
            tmp = *sptr2++;
            *sptr1++ += (((tmp << 3) + 3 * tmp) >> 4);
        }
        break;
    case 11:
        while (--count) {
            *sptr1++ += ((3 * (*sptr2++)) >> 2);
            *sptr1++ += ((3 * (*sptr2++)) >> 2);
            *sptr1++ += ((3 * (*sptr2++)) >> 2);
            *sptr1++ += ((3 * (*sptr2++)) >> 2);
        }
        break;
    case 12:
        while (--count) {
            long tmp;
            tmp = *sptr2++;
            *sptr1++ += (((tmp << 4) - 3 * tmp) >> 4);
            tmp = *sptr2++;
            *sptr1++ += (((tmp << 4) - 3 * tmp) >> 4);
            tmp = *sptr2++;
            *sptr1++ += (((tmp << 4) - 3 * tmp) >> 4);
            tmp = *sptr2++;
            *sptr1++ += (((tmp << 4) - 3 * tmp) >> 4);
        }
        break;
    case 13:
        while (--count) {
```

```
                *sptr1++ += ((7 * (*sptr2++)) >> 3);
                *sptr1++ += ((7 * (*sptr2++)) >> 3);
                *sptr1++ += ((7 * (*sptr2++)) >> 3);
                *sptr1++ += ((7 * (*sptr2++)) >> 3);
            }
            break;
        case 14:
            while (--count) {
                long tmp;
                tmp = *sptr2++;
                *sptr1++ += (((tmp << 4) - tmp) >> 4);
                tmp = *sptr2++;
                *sptr1++ += (((tmp << 4) - tmp) >> 4);
                tmp = *sptr2++;
                *sptr1++ += (((tmp << 4) - tmp) >> 4);
                tmp = *sptr2++;
                *sptr1++ += (((tmp << 4) - tmp) >> 4);
            }
            break;
        case 15:
            while (--count) {
                *sptr1++ += *sptr2++;
                *sptr1++ += *sptr2++;
                *sptr1++ += *sptr2++;
                *sptr1++ += *sptr2++;
            }
            break;
    }
  }

}

short SnDecompress(DecodeBook, ratio, frame_size, min_pitch, bstream, output)
short **DecodeBook, ratio;
unsigned char *bstream;
short *output, frame_size, min_pitch;
{
  short    count, SampCount;
  register short    dstate;
  short    vcount;
  short    vsize, cbook_size, bs_size;

  get_compr_pars(ratio, frame_size, &vsize, &cbook_size, &bs_size);

  dstate = *bstream++;
  dstate = (dstate - 128) << 6;

  SampCount = 0;
```

```
    while((*bstream & LAST_FRAME_FLAG) == 0)
    {
        expand(DecodeBook, frame_size, vsize, min_pitch,
            (struct frame *)bstream, output, SampCount);
        bstream += bs_size;
        SampCount += frame_size;
    }
    vcount = *bstream - LAST_FRAME_FLAG;
    *bstream = *(bstream + 2 + vcount);
    expand(DecodeBook, frame_size, vsize, min_pitch,
        (struct frame *)bstream, output, SampCount);
    *bstream = vcount + LAST_FRAME_FLAG;
    SampCount += vcount * vsize;

    count = (SampCount >> 1) + 1;
    while (--count) {
        *output++ = dstate = ((IPCONS * dstate) >> 3) + *output;
        *output++ = dstate = ((IPCONS * dstate) >> 3) + *output;
    }
    output -= SampCount;

    return SampCount;
}

#define     FILTER  state + PFILT_ORDER+1
#define DC_VAL    state + PFILT_ORDER + PFILT_ORDER/2 + 2
void SnSampExpandFilt(short *src, short off, short len,
    char *dest,short *state)
{
    short       input, temp;
    long        acc;
    register short dc = *(DC_VAL);
    register short *sptr1, *sptr2;

    src += off;
    len++;
    sptr1 = state;
    sptr2 = state + PFILT_ORDER;
    while (--len) {
        input = *src++ - dc;
        dc += input >> 5;

        temp = input + *sptr1++; /* (state[0] + state[8]) * filter[0] */
        acc = temp * *(FILTER);

        temp = *--sptr2 + *sptr1++;  /* (state[1] + state[7]) * filter[1] */
        acc += temp * *(FILTER+1);
```

```
        temp = *--sptr2 + *sptr1++;  /* (state[2] + state[6]) * filter[2] */
        acc += temp * *(FILTER+2);

        temp = *--sptr2 + *sptr1++;  /* (state[3] + state[5]) * filter[3] */
        acc += temp * *(FILTER+3);

        acc += *sptr1 * *(FILTER+4); /* state[4] * filter[4] */

        if (acc > 0)
        {
            temp = (acc + (257 << 20)) >> 21;
            if (temp > 255)
                temp = 255;
        }
        else
        {
            temp = (acc + (255 << 20)) >> 21;
            if (temp < 0)
                temp = 0;
        }
        *dest++ = temp;

        sptr1 -= 4;
        sptr2 -= 4;
        *sptr1++ = *sptr2++;    /* state[0] = state[1] */
        *sptr1++ = *sptr2++;    /* state[1] = state[2] */
        *sptr1++ = *sptr2++;    /* state[2] = state[3] */
        *sptr1++ = *sptr2++;    /* state[3] = state[4] */
        *sptr1++ = *sptr2++;    /* state[4] = state[5] */
        *sptr1++ = *sptr2++;    /* state[5] = state[6] */
        *sptr1++ = *sptr2++;    /* state[6] = state[7] */
        *sptr1 = input;         /* state[7] = input */
        sptr1 -= 7;
    }
    *(DC_VAL) = dc;
}
```

III. BLENDING MODULE

```
/* A module for blending two diphones */

typedef struct {
   short lptr, pitch;
   short weight, weight_inc;
} bstate;

void SnBlend(pitchp lp, pitchp rp, short cur_tot, short tot,
   short type, bstate *bs)
{
#pragma unused (tot)

   short    count;
   short    *ptr1, *ptr2;

   if (type == VOICED)
   {
       if (cur_tot)
           return;
       {
           short    weight;
           long     min_amdf;
           short    best_lag = 0, lag;
           short    window_size;
           short    weight_inc;

           /* First replicate the left pitch period */
           ptr1 = lp->bufp;
           ptr2 = ptr1 + lp->olen;
           count = lp->olen + 1;
           while (--count)
               *ptr2++ = *ptr1++;

           /* Smooth the discontinuity */
           {
               register short en, e2;

               en = lp->bufp[2] +
                   3 * (lp->bufp[0] - lp->bufp[1]) - lp->bufp[lp->olen - 1];

               e2 = lp->bufp[0] - lp->bufp[lp->olen - 1];


               if (en * en > e2 * e2)
```

```
        en = e2;

    ptr2 = lp->bufp + lp->olen;
    count = (lp->olen >> 1) + 1;
    while (--count)
    {
        *--ptr2 += en;
        en = (((en << 4) - en) >> 4);
    }
}

min_amdf = LARGE_NUM;

window_size = rp->olen;
if (lp->olen < rp->olen)
    window_size = lp->olen;

lag = rp->olen;
while (--lag)
{
    long amdf = 0;
    ptr1 = rp->bufp;
    ptr2 = lp->bufp + lag;
    count = ((window_size+3) >> 2) + 1;
    while (--count)
    {
        short tmp;
        tmp = (*ptr1 - *ptr2);
        if (tmp > 0)
            amdf += tmp;
        else
            amdf -= tmp;
        ptr1 += 4;
        ptr2 += 4;
    }
    if (amdf < min_amdf)
    {
        best_lag = lag;
        min_amdf = amdf;
    }
}

bs->pitch = lp->olen;
/* Update left buffer */
if (best_lag < (lp->olen >> 1))
{
    /* Add best_lag samples to the length of left pulse*/
    lp->olen += best_lag;
```

```
            }
            else
            {
                /* Delete a few samples from the left pulse */
                lp->olen = best_lag;
            }
            bs->lptr = best_lag;
            weight_inc = 32767/ window_size;
            weight = 32767 - weight_inc;

            ptr1 = rp->bufp;
            ptr2 = lp->bufp + bs->lptr;
            count = window_size+1;
            while (--count)
            {
                *ptr1++ += (((short) (*ptr2++ - *ptr1) * weight) >> 15);
                weight -= weight_inc;
            }
        }
    }
    else
    {
        register short    delta;

        /* Just blend 15 samples */
        ptr2 = lp->bufp + lp->olen - 15;
        ptr1 = rp->bufp;
/*
        for (i = 1; i < 16; i++)
        {
            *ptr1 = *ptr2 + (i * (*ptr1 - *ptr2)) >> 4;
            ptr1++;
            ptr2++;
        }
*/
        delta = *ptr1 - *ptr2;
        *ptr1++ = *ptr2++ + (delta >> 4);

        delta = *ptr1 - *ptr2;
        *ptr1++ = *ptr2++ + ((delta) >> 3);

        delta = *ptr1 - *ptr2;
        *ptr1++ = *ptr2++ + ((3 * delta) >> 4);

        delta = *ptr1 - *ptr2;
        *ptr1++ = *ptr2++ + (delta >> 2);

        delta = *ptr1 - *ptr2;
```

- 58 -

```
        *ptr1++ = *ptr2++ + ((5 * delta) >> 4);

        delta = *ptr1 - *ptr2;
        *ptr1++ = *ptr2++ + ((3 * delta) >> 8);

        delta = *ptr1 - *ptr2;
        *ptr1++ = *ptr2++ + ((7 * delta) >> 4);

        delta = *ptr1 - *ptr2;
        *ptr1++ = *ptr2++ + (delta >> 1);

        delta = *ptr1 - *ptr2;
        *ptr1++ = *ptr2++ + (((delta << 3) + delta) >> 4);

        delta = *ptr1 - *ptr2;
        *ptr1++ = *ptr2++ + ((5 * delta) >> 3);

        delta = *ptr1 - *ptr2;
        *ptr1++ = *ptr2++ + (((delta << 3) + 3 * delta) >> 4);

        delta = *ptr1 - *ptr2;
        *ptr1++ = *ptr2++ + ((3 * delta) >> 2);

        delta = *ptr1 - *ptr2;
        *ptr1++ = *ptr2++ + (((delta << 4) - 3 * delta) >> 4);

        delta = *ptr1 - *ptr2;
        *ptr1++ = *ptr2++ + ((7 * delta) >> 3);

        delta = *ptr1 - *ptr2;
        *ptr1 = *ptr2 + (((delta << 4) - delta) >> 4);


        lp->olen -= 15;
    }
}
```

- 59

IV. INTONATION ADJUSTMENT MODULE

```
/* A module for deleting a pitch period */
/*
   Pointer src1 points to Left Pitch period
   Pointer src2 points to Right Pitch period
   Pointer dst points to Resulting Pitch period
   len = length of the pitch periods
*/
skip_pulses(short *src1, short *src2, short *dst, short len)
{
   short i;
   register short    weight, cweight;

   i = len+1;
   weight = cweight = 32767/i;
   while (--i)
   {
       *dst++ = *src1++ + (((short) (*src2++ - *src1) * cweight) >> 15);
       cweight += weight;
   }
}

/* A module for Inserting a pitch period */
/*
   Locn buffer[curbeg] points to Left Pitch period
   Locn buffer[curbeg+curlen] points to Right Pitch period
   Pointer dst points to Resulting Pitch period
   curlen = length of the pitch periods
*/
insert_pulse(short *buffer, short *dst, short curlen,  short curbeg)
{
   short    weight, cweight, count;
   short    *src1, *src2;

   src1 = buffer + curbeg;
   src2 = buffer + curbeg + curlen;
   weight = 32767 / curlen;
   cweight = weight;
   count = curlen + 1;
   while (--count)
   {
       *dst++ = *src1++ = *src2++ + (((short) (*src1 - *src2) * cweight) >>
15);
       cweight += weight;
   }
}
```

```
/* This module is used to change pitch information in the concatenated speech */

// This routine depends on the desired length (deslen) being at least half
// and no more than twice the actual length (len).

void SnChangePitch(short *buf, short *next, short len, short deslen,short lvoc,short
rvoc,short dosmooth)
{
#pragma unused(rvoc, dosmooth)
    short   delta;
    short   count;
    short   *bptr, *aptr;
    short   weight, weight_inc;
    if (!lvoc || (deslen == len)) return;

    if (deslen > len)
    {
        /* Increase Pitch period */
        delta = deslen - len;
        bptr = buf + len;
        aptr = buf + deslen;
        count = delta + 1;
        while (--count)
            *--aptr = *--bptr;

        count = len - delta + 1;
        weight = weight_inc = 32767 / count;
        while (--count)
        {
            register short tmp2;
            tmp2 = (*--aptr - *--bptr);
            *aptr = *bptr + ((tmp2 * weight) >> 15);
            weight += weight_inc;
        }
        return;
    }
    {
        /* Shorten Pitch Period */
        short wsize;

        delta = len - deslen;
        wsize = 2 * delta;

        if (wsize > deslen)
            wsize = deslen;

        weight_inc = 32767 / (wsize + 1);
        weight = weight_inc;
```

- 61 -

```
        aptr = buf + deslen;
        bptr = buf + len - wsize;
        count = wsize - delta + 1;
        while (--count)
        {
            *bptr++ += (((short) (*aptr++ - *bptr) * weight ) >> 15);
            weight += weight_inc;
        }
        aptr = buf + deslen;
        bptr = next;
        count = delta + 1;
        weight = 32767 - weight;
        while (--count)
        {
            *bptr++ += (((short) (*aptr++ - *bptr) * weight ) >> 15);
            weight -= weight_inc;
        }
    }
}
```

What is claimed is:

1. An apparatus for adjusting an intonation of a sound wherein the sound is specified by a sequence of frames each comprising a set of digital samples, the apparatus comprising:

means for receiving a set of intonation control signals that indicate a pitch adjustment and a duration adjustment to the sound;

buffer that stores the sequence of frames;

intonation control means that generates an intonation adjusted sequence of frames by accessing a block of one or more frames of the sequence of frames from the buffer and by generating a modified block in response to the intonation control signals and by inserting the modified block into the sequence of frames wherein the intonation control means minimizes discontinuity between a beginning segment and an ending segment of the block and a pair of adjacent frames in the intonation adjusted sequence of frames, wherein the intonation control signals indicate a change in a nominal length of a specified frame of the sequence of frames to indicate the pitch adjustment and indicate a change in a number of frames in the sequence of frames to indicate the duration adjustment, and wherein the intonation control means includes pitch lowering means for increasing a length N of the specified frame by an amount equal to Δ samples wherein the block of one or more frames consists of the specified frame, the pitch lowering means including means for applying a first weighting function to the block emphasizing the beginning segment to generate a first vector and means for applying a second weighting function to the block emphasizing the ending segment to generate a second vector and means for combining the first vector with the second vector shifted by Δ samples to generate the modified block having a length N+Δ, pitch raising means for decreasing the length N of the specified frame by an amount equal to Δ samples wherein the block of one or more frames consists of the specified frame and a next frame having a length NR in the sequence of frames, the pitch raising means including means for applying the first weighting function to the block emphasizing the beginning segment to generate the first vector and means for applying the second weighting function to the block emphasizing the ending segment to generate the second vector and means for combining the first vector with the second vector shifted by Δ samples to generate a shortened frame with the next frame to generate the modified block having a length N−Δ+NR, duration shortening means for modifying the block to reduce the number of frames in the sequence of frames wherein the block consists of a pair of sequential frames having lengths NL and NR respectively, the duration shortening means including means for applying the first weighting function to the block emphasizing the beginning segment to generate the first vector and means for applying the second weighting function to the block emphasizing the ending segment to generate the second vector and means for combining the first vector with the second vector to generate the modified block having the length NL or the length NR, and duration lengthening means for modifying the block to increase the number of frames in the sequence of frames wherein the block consists of a pair of left and right sequential frames having the lengths NL and NR respectively, the duration lengthening means including means for applying the first weighting function to the block emphasizing the beginning segment to generate the first vector and means for applying the second weighting function to the block emphasizing the ending segment to generate the second vector and means for combining the first vector with the second vector to generate a new frame and means for concatenating the left frame, the new frame, and the right frame to generate the modified block.

2. An apparatus for adjusting an intonation of a sound wherein the sound is specified by a sequence of frames each comprising a set of digital samples, the apparatus comprising:

means for receiving a set of intonation control signals that indicate a pitch adjustment and a duration adjustment to the sound;

buffer that stores the sequence of frames;

intonation control means that generates an intonation adjusted sequence of frames by accessing a block of one or more frames of the sequence of frames from the buffer and by generating a modified block in response to the intonation control signals and by inserting the modified block into the sequence of frames such that the intonation control frames minimizes a discontinuity between a beginning segment and an ending segment of the block and a pair of adjacent frames in the intonation adjusted sequence of frames;

wherein the intonation control signals indicate a change in a nominal length of a specified frame of the sequence of frames to indicate the pitch adjustment and indicate a change in a number of frames in the sequence of frames to indicate the duration adjustment and, wherein the intonation control means includes pitch lowering means for increasing a length N of the specified frame by an amount equal to Δ samples wherein the block of one or more frames consists of the specified frame, the pitch lowering means including means for applying a first weighting function to the block emphasizing the beginning segment to generate a first vector and means for applying a second weighting function to the block emphasizing the ending segment to generate a second vector and means for combining the first vector with the second vector shifted by Δ samples to generate the modified block having a length N+Δ.

3. An apparatus for adjusting an intonation of a sound wherein the sound is specified by a sequence of frames each comprising a set of digital samples, the apparatus comprising:

means for receiving a set of intonation control signals that indicate a pitch adjustment and a duration adjustment to the sound;

buffer that stores the sequence of frames;

intonation control means that generates an intonation adjusted sequence of frames by accessing a block of one or more frames of the sequence of frames from the buffer and by generating a modified block in response to the intonation control signals and by inserting the modified block into the sequence of frames such that the intonation control frames minimizes a discontinuity between a beginning segment and an ending segment of the block and a pair of adjacent frames in the intonation adjusted sequence of frames;

wherein the intonation control signals indicate a change in a nominal length of a specified frame of the sequence of frames to indicate the pitch adjustment and indicate a change in a number of frames in the sequence of frames to indicate the duration adjustment and, wherein the intonation control means includes pitch raising means for decreasing a length N of the specified frame by an amount equal to Δ samples wherein the block of one or more frames consists of the specified frame and a next frame having a length NR in the sequence of frames, the pitch raising means including means for applying a first weighting function to the block emphasizing the beginning segment to generate a first vector and means for applying a second weighting function to the block emphasizing the ending segment to generate a second vector and means for combining the first vector with the second vector shifted by Δ samples to generate a shortened frame with the next frame to generate the modified block having a length N−Δ+NR.

4. An apparatus for adjusting an intonation of a sound wherein the sound is specified by a sequence of frames each comprising a set of digital samples, the apparatus comprising:

means for receiving a set of intonation control signals that indicate a pitch adjustment and a duration adjustment to the sound;

buffer that stores the sequence of frames;

intonation control means that generates an intonation adjusted sequence of frames by accessing a block of one or more frames of the sequence of frames from the buffer and by generating a modified block in response to the intonation control signals and by inserting, the modified block into the sequence of frames such that the intonation control frames minimizes a discontinuity between a beginning segment and an ending segment of the block and a pair of adjacent frames in the intonation adjusted sequence of frames;

wherein the intonation control signals indicate a change in a nominal length of a specified frame of the sequence of frames to indicate the pitch adjustment and indicate a change in a number of frames in the sequence of frames to indicate the duration adjustment and, wherein the intonation control means includes duration shortening means for modifying the block to reduce the number of frames in the sequence of frames wherein the block consists of a pair of sequential frames having lengths NL and NR respectively, the duration shortening means including means for applying a first weighting function to the block emphasizing the beginning segment to generate a first vector and means for applying a second weighting function to the block emphasizing the ending segment to generate a second vector and means for combining the first vector with the second vector to generate the modified block having the length NL or the length NR.

5. An apparatus for adjusting an intonation of a sound wherein the sound is specified by a sequence of frames each comprising a set of digital samples, the apparatus comprising:

means for receiving a set of intonation control signals that indicate a pitch adjustment and a duration adjustment to the sound;

buffer that stores the sequence of frames;

intonation control means that generates an intonation adjusted sequence of frames by accessing a block of one or more frames of the sequence of frames from the buffer and by generating a modified block in response to the intonation control signals and by inserting the modified block into the sequence of frames such that the intonation control frames minimizes a discontinuity between a beginning segment and an ending segment of the block and a pair of adjacent frames in the intonation adjusted sequence of frames;

wherein the intonation control signals indicate a change in a nominal length of a specified frame of the sequence of frames to indicate the pitch adjustment and indicate a change in a number of frames in the sequence of frames to indicate the duration adjustment and, wherein the intonation control means includes duration lengthening means for modifying the block to increase the number of frames in the sequence of frames wherein the block consists of a pair of left and right sequential frames having lengths NL and NR respectively, the duration lengthening means including means for applying a first weighting function to the block emphasizing the beginning segment to generate a first vector and means for applying a second weighting function to the block emphasizing the ending segment to generate a second vector and means for combining the first vector with the second vector to generate a new frame and means for concatenating the left frame, the new frame, and the right frame to generate the modified block.

* * * * *